US010865942B2

(12) United States Patent
Banerjee et al.

(10) Patent No.: US 10,865,942 B2
(45) Date of Patent: Dec. 15, 2020

(54) CONTAINER PANEL AND STRUCTURES USING CONTAINER PANELS

(71) Applicant: NEXGEN COMPOSITES LLC, Franklin, OH (US)

(72) Inventors: Robin Banerjee, Centerville, OH (US); Robert L. Lapoint, Charleston, SC (US); Michael S. Sheppard, Centerville, OH (US)

(73) Assignee: NEXGEN COMPOSITES LLC, Franklin, OH (US)

( * ) Notice: Subject to any disclaimer, the term of this patent is extended or adjusted under 35 U.S.C. 154(b) by 49 days.

(21) Appl. No.: 16/172,242

(22) Filed: Oct. 26, 2018

(65) Prior Publication Data

US 2019/0128478 A1 May 2, 2019

Related U.S. Application Data

(60) Provisional application No. 62/580,562, filed on Nov. 2, 2017, provisional application No. 62/577,702, filed on Oct. 26, 2017.

(51) Int. Cl.
*B65D 90/00* (2006.01)
*E04H 1/12* (2006.01)
(Continued)

(52) U.S. Cl.
CPC ..... *F17C 3/027* (2013.01); *B65D 90/00* (2013.01); *E04B 1/344* (2013.01); *E04H 1/1205* (2013.01);
(Continued)

(58) Field of Classification Search
CPC ... E04H 1/1205; E04B 1/3444; E04B 1/3442; E04B 1/34357; E04B 1/34384; E04B 1/344; E04B 1/34; E04B 1/83
See application file for complete search history.

(56) References Cited

U.S. PATENT DOCUMENTS 3,752,349 A 8/1973 Rana
4,633,626 A * 1/1987 Freeman ..... E04B 1/34315 52/126.6
(Continued)

FOREIGN PATENT DOCUMENTS

DE 2620689 B1 * 10/1977 ..... E04B 1/3444
EP 0246300 B1 6/1992
(Continued)

OTHER PUBLICATIONS

Klinge Corporation; Klinge Temperature Control; "Expandable Tri-Con Refrigeration Unit"; located at https://klingecorp.com/military/expandable-triple-container-refrigeration-unit/ on Aug. 3, 2017.

*Primary Examiner* — Christine T Cajilig
(74) *Attorney, Agent, or Firm* — Thomas E. Lees, LLC

(57) ABSTRACT

According to aspects of the present disclosure, a process of fabricating a unitized container panel is disclosed. The unitized container panel is fabricated by forming a multi-layer insulated panel, which has opposing external layers and an intermediate layer therebetween. The intermediate layer is a combination of an insulation material (e.g., vacuum insulated panel, aerogel, etc.), and a buffer material (e.g., a foam board, polystyrene, fiberglass, minerals, plastic, natural fibers, wood, plastic, etc.) that bounds the insulation material. Pressure is applied about the multilayer insulated panel for a predetermined process time, causing the external layers to encase the intermediate layer. After elapse of the predetermined process time, the pressure is released about the multilayer insulated panel, thereby resulting in a unitized container panel.

9 Claims, 19 Drawing Sheets

(51) Int. Cl.
*E04B 1/344* (2006.01)
*F17C 3/02* (2006.01)
*F17C 1/12* (2006.01)

(52) U.S. Cl.
CPC ..... *F17C 1/12* (2013.01); *F17C 2201/052* (2013.01); *F17C 2203/0358* (2013.01); *F17C 2203/0391* (2013.01); *F17C 2203/0626* (2013.01)

(56) References Cited

U.S. PATENT DOCUMENTS 7,726,496 B2 * 6/2010 Heinrichs ..... B65D 88/522 211/191
7,966,775 B2 * 6/2011 Medley ..... E04B 1/3444 52/79.5
8,650,806 B1 * 2/2014 Condie ..... E04H 1/1205 52/79.5
8,739,474 B2 6/2014 Chang et al.
9,109,354 B2 8/2015 Toubia et al.
10,219,447 B1 * 3/2019 DeCarli ..... A01G 9/16
2008/0134589 A1 * 6/2008 Abrams ..... E04B 1/34807 52/79.1
2008/0256878 A1 * 10/2008 Berns ..... E04B 1/3444 52/79.6
2012/0006369 A1 * 1/2012 Cantin ..... E04B 1/3444 135/96
2013/0305626 A1 * 11/2013 Strickland ..... E04B 1/34384 52/79.5
2014/0202089 A1 * 7/2014 Nakajima ..... E04H 3/28 52/79.5
2016/0069062 A1 * 3/2016 Dynon ..... E04B 1/34815 52/79.5
2019/0330839 A1 * 10/2019 Mallinowski ..... E04B 1/3483

FOREIGN PATENT DOCUMENTS

FR 1134409 A * 4/1957 ..... E04B 1/3444
GB 2470734 A 12/2010

* cited by examiner

ISOMETRIC REAR VIEW

CONTAINER PANEL AND STRUCTURES USING CONTAINER PANELS

CROSS REFERENCE TO RELATED APPLICATIONS

This application claims the benefit of U.S. Provisional Patent Application Ser. No. 62/580,562, filed Nov. 2, 2017, entitled CONTAINER PANEL AND STRUCTURES USING CONTAINER PANELS, and claims the benefit of U.S. Provisional Patent Application No. 62/577,702, filed Oct. 26, 2017, entitled CONTAINER PANEL AND STRUCTURES USING CONTAINER PANELS, the disclosures of which are hereby incorporated by reference.

STATEMENT REGARDING FEDERALLY SPONSORED RESEARCH OR DEVELOPMENT

This invention was made with government support under Contract No. W911QY-15-C-0040-P00001 awarded by the U.S. Army. The Federal Government has certain rights in the invention.

BACKGROUND

Various aspects of the present disclosure relate to container panels, and to structures constructed using container panels, such as containers, expandable containers, and other container systems.

A container is a tool that creates a partially or fully enclosed space. In this regard, containers may be used for various reasons. For instance, containers may be used to contain, hold, or otherwise store items. Containers may also be used to transport items to and from various locations.

BRIEF SUMMARY

According to aspects of the present disclosure, a process of fabricating a unitized container panel is disclosed. The unitized container panel is fabricated by forming a multilayer insulated panel, which has opposing external layers and an intermediate layer therebetween. The intermediate layer is a combination of an insulation material (e.g., vacuum insulated panel, aerogel, etc.), and a buffer material (e.g., a foam board, polystyrene, fiberglass, minerals, plastic, natural fibers, wood, plastic, etc.) that bounds the insulation material. Pressure is applied about the multilayer insulated panel for a predetermined process time, causing the external layers to encase the intermediate layer. After elapse of the predetermined process time, the pressure is released about the multilayer insulated panel, thereby resulting in a unitized container panel.

According to further aspects of the present disclosure, a unitized container is disclosed. The unitized container includes a set of panels including a floor panel, a roof panel, a front panel, a rear panel, a right side panel, and a left side panel that correspond to one another. When the unitized container is assembled, the floor panel defines a floor surface. The front panel is assembled to the floor panel such that an edge thereof is orthogonal to a first edge of the floor panel. Similarly, the right side panel is assembled to the floor panel such that an edge thereof is orthogonal to a second edge of the floor panel. Also, the rear panel is assembled to the floor panel such that an edge thereof is orthogonal to a third edge of the floor panel. Moreover, the left side panel is assembled to the floor panel such that an edge thereof is orthogonal to a fourth edge of the floor panel. The roof panel defines a roof surface and is coupled to the front panel, the right side panel, the rear panel, and the left side panel.

At least one panel in the set of panels comprises a multilayer insulated panel comprising opposing external layers encasing an intermediate layer therebetween to form a unitized container panel, the intermediate layer comprising an insulation material and a buffer material encasing the insulation material. Yet further, at least one panel in the set of panels comprises an access point into an interior space of the unitized container.

According to aspects of the present disclosure, an expandable container is disclosed. The expandable container has a floor panel, and a roof panel that corresponds to the floor panel. The expandable container also includes a first set of expansion panels that correspond to the floor panel and the roof panel. The first set of expansion panels includes a first expansion roof panel, a first expansion front panel, a first expansion floor panel, a first expansion compound panel. The first expansion compound panel has a first rear swing panel and a first side swing panel.

The first set of expansion panels articulate using a plurality of hinges and fasten to one another using a plurality of locking members. Moreover, at least one panel of the first set of expansion panels comprises a multilayer insulated panel comprising opposing external layers encasing an intermediate layer therebetween to form a unitized container panel, the intermediate layer comprising an insulation material and a buffer material encasing the insulation material.

DETAILED DESCRIPTION

Figure 1:
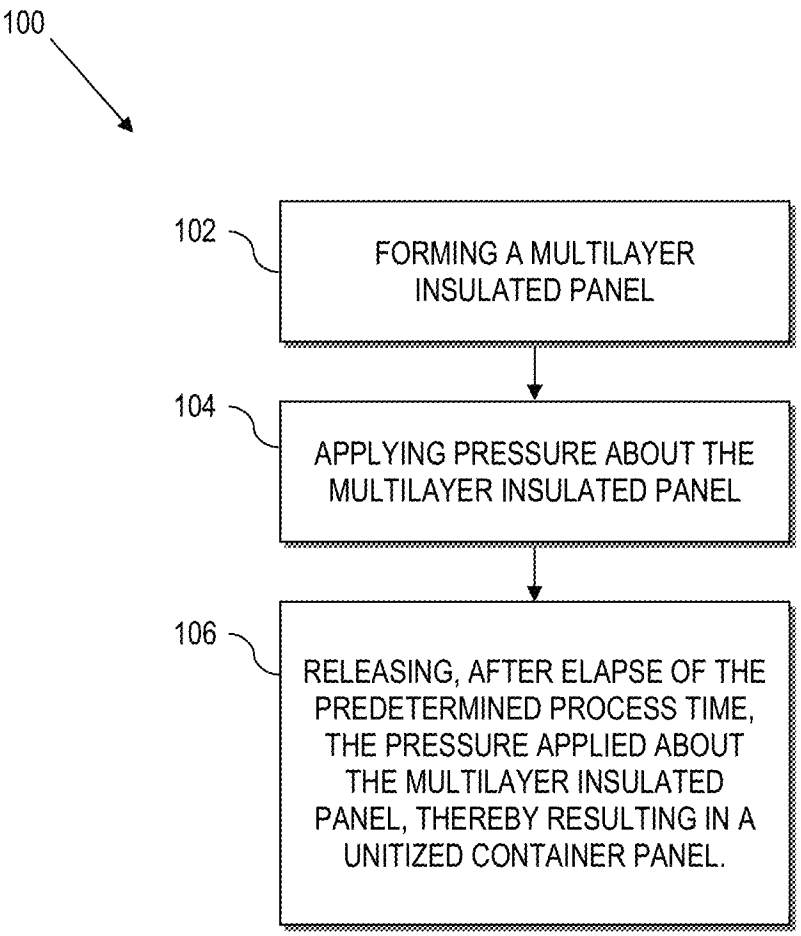
FIG. 1 is a process flow chart for fabricating a unitized container panel according to various aspects of the present disclosure.

The present disclosure relates generally to container panels, and to structures constructed using container panels, such as containers, expandable containers, and other container systems. For instance, various embodiments of the present disclosure relate to container panels and corresponding processes of fabricating container panels. As will be described in greater detail herein, a container panel, when constructed, defines a unitized structure having multiple layers, including an intermediate insulation layer. For instance, a container panel may be fabricated as a multilayer insulated panel comprising opposing external layers encasing an intermediate layer therebetween to form a unitized container panel, the intermediate layer comprising an insulation material and a buffer material encasing the insulation material, as described in greater detail herein.

Further aspects of the present disclosure relate to containers constructed using at least one container panel as described more fully herein. In this regard, a container can be a permanently assembled structure, or the container can be readily assembled/disassembled. For instance, a container can be disassembled into component parts for ease of transportation, and then deployed in the field (e.g., at a suitable location) back into a container. In this regard, the assembled container can function as a storage unit, as a housing unit, shelter, or for any other reasonable purpose. In some embodiments, the container can be assembled such that all necessary parts are integrated into the container panels or are otherwise incorporated therewith. This reduces or eliminates the potential for loosing parts necessary to assemble the container.

In yet further embodiments, expandable containers are provided, which utilize at least one container panel as described more fully herein. An expandable container can be condensed down (e.g., to a one container footprint thus providing a compact configuration). However, when deployed, the expandable container can be increased in size to a footprint larger than a single container. As with a non-expandable container embodiment, in some embodiments, the expandable container can be assembled such that all necessary parts are integrated into the container panels or are otherwise incorporated therewith. This reduces or eliminates the potential for loosing parts necessary to assemble the container.

By way of illustration, "expandable bicons" have a footprint of a standard bicon container (usually 8 ft. (feet)×10 ft. (i.e., 2.4 meters (m)×3 m)) when collapsed and can be expanded to various configurations; "expandable tricons" have a footprint of a standard tricon container (usually 8 ft.×6 ft. 8 inches (i.e., 2.4 m×2 m)) when collapsed and can be expanded to various configuration; "expandable quadcons" have a footprint of a standard quadcon container (usually 8 ft.×5 ft. (i.e., 2.4 m×1.5 m)) when collapsed and can be expanded to various configurations; "expandable twenty ft. containers" have a footprint of a standard twenty ft. container (usually 8 ft.×20 ft. (i.e., 2.4 m×6 m)) when collapsed and can be expanded to various configuration; etc.

There are multiple advantages attributable to expandable containers. For instance, the ability to compact multiple container's worth of volume into a reduced footprint (e.g., a single container) may make an expandable container more efficient for travel when compared to traditional containers, especially over water, air, rough terrain, etc., where cargo space is a luxury for water vessels, aircraft, and land transportation vehicles.

Further, the ability to collapse an expandable container back into a compact footprint, move the collapsed expandable container to another location, and re-deploy the expandable container to its expanded form may allow mobile users (e.g., militaries, first responders, etc.) to more efficiently transport the expandable container along with a base camp or forward operating base. During a deployment, the base camp or forward operating base may be required to relocate multiple times. Having a container that can collapse, transport, and deploy can reduce the man hours spent on the relocation process.

According to further aspects of the present disclosure, container panels are constructed having a high insulation value, which is particularly useful for constructing containers that require environmental control (e.g., cooling, freezing, heating, etc.). Such construction panels may thus translate to lower operational costs when utilizing temperature-controlled container.

One metric to measure the effectiveness of insulation is R-value, which is a measure of thermal resistance (i.e., an ability of heat to transfer from hot to cold) through materials (such as insulation) and assemblies of materials (such as walls and floors). The higher the R-value, the more a material prevents heat transfer. An R-value depends on a materials' resistance to heat conduction, as well as the thickness and any heat losses due to convection and radiative heat transfer (for loose or porous material). For example, the R-value of wood is 1, noted as R-1.

Certain insulating material (e.g., Vacuum insulation panels (VIPs)) typically have high R-values when compared to other materials such as wood. A VIP is a form of thermal insulation comprising a gas-tight enclosure surrounding a rigid core (e.g., fumed porous silica), from which the air has been evacuated. VIPs are commonly used in building construction due to higher insulation performance when compared to conventional insulation materials.

However, VIPs can be more susceptible to damage than other materials. In an event where a VIP is damaged (e.g., punctured), the R-value can reduce to near zero in some cases. This vulnerability may become more prevalent in applications where structures utilizing VIPs are not fixed in location.

However, aspects of the present disclosure provide container panel construction techniques that enable the integration of insulating material, including VIP, by forming unitized structures that are resistant to damage that could otherwise compromise an internal VIP.

General Overview

Referring to drawings and in particular to FIG. 1, a process 100 for fabricating a unitized container panel is disclosed. The process 100 comprises forming at 102 a multilayer insulated panel comprising opposing external layers, and an intermediate layer therebetween. The intermediate layer comprises an insulation material and a buffer material encasing the insulation material. For this disclosure, encasing does not mean that the buffer material (or the external layers) completely surround the underlying materials (e.g., the buffer material does not need to completely surround the insulation material). Rather, the buffer material can encase (e.g., overlie a side) opposing sides, etc., of the insulation material.

Further, the process 100 comprises applying, at 104, pressure about the multilayer insulated panel for a predetermined process time, causing the external layers to encase the intermediate layer.

Moreover, the process 100 comprises releasing at 106, after elapse of the predetermined process time, the pressure applied about the multilayer insulated panel, thereby resulting in a unitized container panel.

Forming at 102, a multilayer insulated panel can be implemented by positioning external layers to oppose the intermediate layer. The external layers can serve as a protective layer for the intermediate layer and form the external surfaces of the container panel. In this regard, the external layers can be made from a wide variety of materials to serve that purpose.

In various embodiments, the process 100 comprises fabricating the external layer out of at least one of a fiber reinforced composite material, a plastic material, a metallic material, a wood material, a honeycomb material (open cell or closed cell), or a combination thereof. The honeycomb material can be fabricated out of at least one of a metal material, a plastic material, and a paper material. Further, the honeycomb material can be fabricated using a closed cell honeycomb configuration.

Forming at 102, a multilayer insulated panel can be implemented by positioning the buffer material between the opposing external layers to encase the insulation material. With respect to the buffer material, various materials can be used. In multiple embodiments, encasing the insulation material comprises using at least one of a foam board, a loose foam board, polystyrene, cellulose, fiberglass, minerals (e.g., rock or slag), plastic, natural fibers, wood, plastic, and a foil material as the buffer material. The buffer material can serve various functions such as increasing the insulation value of the unitized panel depending on the material that is used as the buffer material. Moreover, in conjunction with the external layers, the buffer material may serve as another layer of protection for the insulation.

In some embodiments, equally spaced support members are placed within the buffer material equally spaced support members within the buffer material as a reinforcement layer to provide extra support and overall structure to the intermediate layer. Examples of support members placed within the buffer material include materials such as fiber reinforced composite materials, wood, plywood, metal, plastics, honeycomb materials, composite materials, etc., and can be placed in an repeating pattern, such as every six to twelve inches (approximately 15.24 centimeters to approximately 30.48 centimeters) (or other reasonable spacing or pattern) throughout the length of the buffer material.

In the event additional support is needed, additional embodiments of the process 100 comprises placing a reinforcement layer between the buffer material and the insulation material, wherein the reinforcement layer is comprised out of at least one of a fiber reinforced composite material, a plastic material, a metallic material, a wood material, a honeycomb material, or a combination thereof. The reinforcement layer is substantially similar to the external layers, except that the reinforcement layers are within the intermediate layer.

Forming at 102, a multilayer insulated panel can be implemented by positioning the insulation material to be encased by the buffer material. The insulation material serves as an insulation layer for the unitized container panel and will be discussed in greater detail herein.

Example Unitized Container Panel Layers

Figure 2:
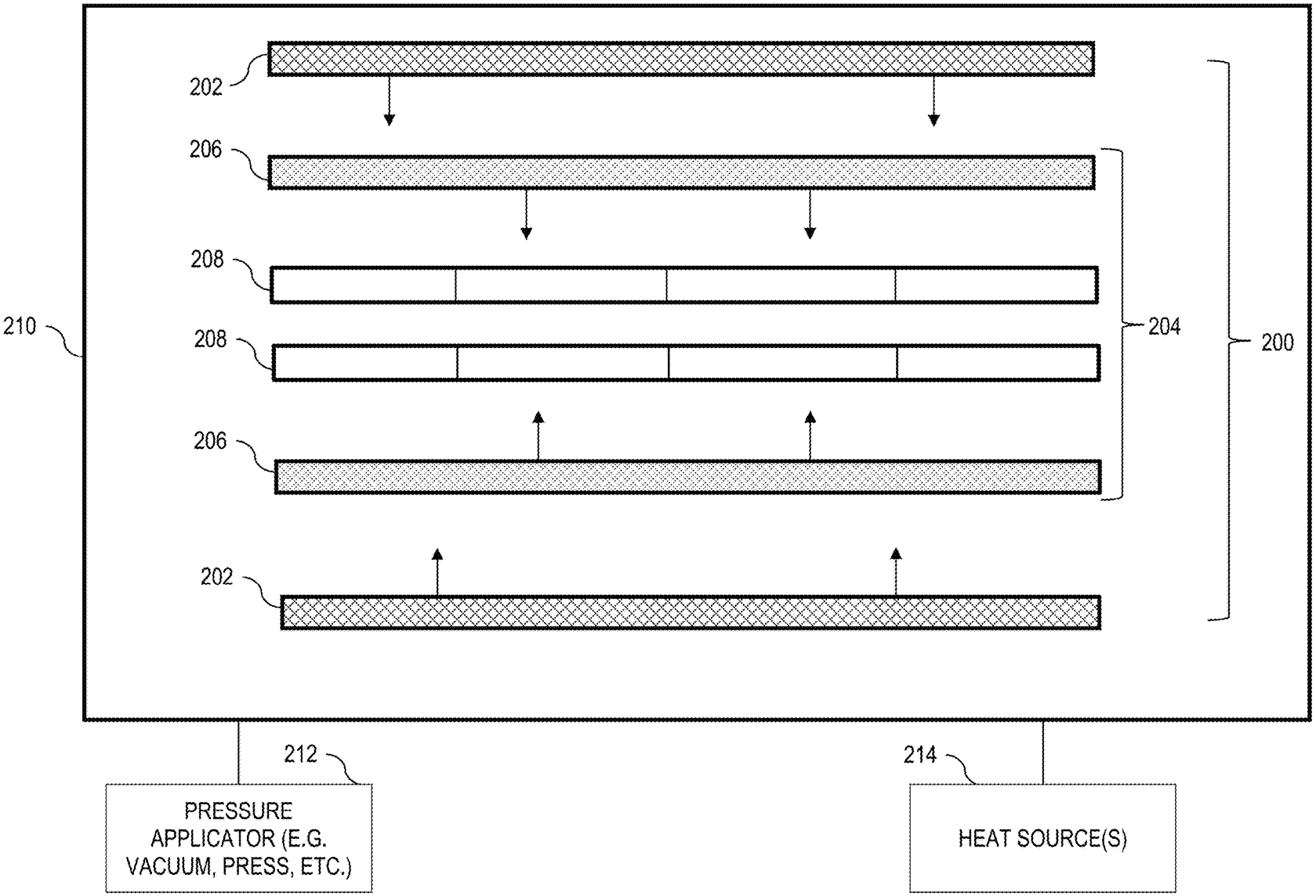
FIG. 2 is an exploded view of layers of a unitized container panel made from the process in FIG. 1 according to various aspects of the present disclosure.

Now referring to FIG. 2 an exploded view illustrates layers of an example multilayer insulated panel 200 formed using the process 100 in FIG. 1, according to various aspects of the present disclosure.

As illustrated, the multilayer insulated panel 200 comprises opposing external layers 202, which form the outside surface of the multilayer insulated panel 200. The external layers 202 are fabricated out of a durable material such as a fiber reinforced composite material, a plastic material, a metallic material, a wood material, an open cell honeycomb material, a closed cell honeycomb material, or a combination thereof, which is particularly advantageous when using insulation material such as VIP, aerogel, etc., as described more fully herein.

In the illustrated embodiment, an intermediate layer 204 (core) of the multilayer insulated panel 200 is comprised of various materials based upon factors such as the desired R-value. In various embodiments, one of which is illustrated in FIG. 2, the intermediate layer 204 is comprised of opposing layers of buffer material 206 that encase an insulation material 208 therebetween. The multiple layers that comprises the intermediate layer 204 are disposed between the opposing external layers 202. Each respective layer can be attached or bonded to the other layers using various materials such as adhesives.

With respect to the insulation material 208, a variety of different materials and configurations may be used. In some embodiments, the insulation material 208 comprises using at least one of a vacuum insulated panel, and an aerogel. As described above, the insulation material(s) can be arranged in multiple configurations to suit specific needs (e.g., offset for structural redundancy).

In further embodiments, the insulation material 208 is arranged as an insulation material array (e.g., an ordered series, arrangement, or pattern of insulation layers). For instance, one or more layers of insulation material 208 can be assembled together (e.g., in one or more rows) one or more staggered rows, arrays, columns, grids, other orders, combinations thereof, etc.

Under certain implementations of the present disclosure, arranging the VIPs as an insulation material array yields a higher R-value than a traditional VIP configuration. The R-value of VIPs can vary depending on the materials used and the thickness of the VIP. For example, a typical VIP may have an R-value ranging from R-25 to R-50. However, VIPs arranged as an insulation material array may yield an R-value up to R-82. These example values may vary based on a variety of factors such as the quality of the materials used, and the overall environmental conditions.

Moreover, staggering rows of VIP can reduce, localize, minimize, or otherwise negate adverse effects should one or more VIPs become compromised. For instance, in an example implementation, the insulation material (e.g., VIP) is arranged as an insulation material array of at least two layers of the insulation material, where each layer is offset from one another. VIPs arranged as an insulation material array, and especially as an offset array, can provide structural redundancy. If one layer of the insulation material array is damaged, the other layer(s) can continue to function and provide insulation.

The overall thickness for each layer may vary based on need. In one example implementation, the external layers (e.g., fiberglass composite layer) 202 are 0.1 inch (approximately 0.254 cm) thick, the buffer material 206 is 0.5 inch (approximately 1.27 cm) thick, and the insulation material 208 is 0.5 to 1.5 inch (approximately 1.27 cm to approximately 3.81 cm) thick. In an example embodiment, a reinforcement layer is utilized, and the reinforcement layer is 0.5 inch (approximately 1.27 cm) thick.

Upon selection of the materials for the individual layers of the multilayer insulated panel 200, the individual layers are introduced into a staging area 210 where a unitized container panel is fabricated. As noted above, fabricating the unitized container panel comprises applying pressure to the multilayer insulated panel 200.

With respect to applying pressure about the multilayer insulated panel 200, multiple techniques may be used. For example, applying pressure about the multilayer insulated panel 200 for a predetermined process time may comprise applying pressure about the multilayer insulated panel 200 using a pressure applicator 212. In an example implementation, the pressure applicator 212 is a press. In further embodiments, applying pressure about the multilayer insulated panel 200 for a predetermined process time comprises applying pressure about the multilayer insulated panel 200 using a pressure applicator 212 that draws a vacuum.

Generally, a vacuum is created by evacuating air from a closed volume to develop a pressure differential between the volume and the surrounding atmosphere. In this enclosed volume, the atmospheric pressure will press the two (or more) objects together. The amount of holding force depends on the surface area shared by the two objects and the vacuum level.

For example, in an industrial vacuum system, a vacuum pump or generator removes air from a system to create a pressure differential. Multiple types of pumps may be utilized to achieve the pressure differential. Examples include positive-displacement pumps such as reciprocating and rocking pistons, rotary vanes, diaphragms, lobed rotors, and rotary screw designs. Further, non-positive-displacement pumps such as multi-stage centrifugal, axial flow units, and regenerative (or peripheral) blowers may also be used.

In various embodiments of the present disclosure, the multilayer insulated panel 200 may be heated at various phases of fabrication. For example, a heat source 214 may be used to apply heat prior to applying pressure about the multilayer insulated panel 200, layer formation, during pressure application, after pressure application, combinations thereof, etc. In example implementations, the staging area 210 may be a surface that is configured to support the heat source 214, which may be primed before formation of the multilayer insulated panel 200 (e.g., a table with a built-in heating element, or a layer containing a heating element placed on the staging area 210 before the external layers 202 of the multilayer insulated panel 200).

In various embodiments, heating the multilayer insulated panel 200 comprises heating the multilayer insulated panel 200 at a temperature in the range of 80° F. to 500° F. for at least 5 minutes and drawing a vacuum about the multilayer insulated panel between about one Torr and about 760 Torr for at least 5 minutes while the multilayer insulated panel is being heated.

Moreover, a heat source 214 may be placed over the multilayer insulated panel 200 in addition to (and/or in lieu of) being placed under the multilayer insulated panel 200 as noted above. Utilization of the heat source 214 as described herein may allow the various layers of the multilayer insulated panel 200 to adhere more effectively to one another.

Unitized Container Panel Construction Example Use Case

In an example scenario relating to fabrication of a unitized container panel, a first portion of an external layer (comprised of at least one of a fiber reinforced composite material, a plastic material, a metallic material, a wood material, a honeycomb material, or a combination thereof) is placed on the staging area. A bonding material such as an adhesive (e.g., liquid or film) is then spread over the first portion of the external layer. Next, a first portion of a buffer material (comprised of at least one of a foam board, a loose foam board, polystyrene, cellulose, fiberglass, minerals, plastic, natural fibers, wood, plastic, and a foil material) in placed on the first portion of the external layer.

After another application of the bonding material, an insulation material (e.g., vacuum insulation panel, aerogel, etc.) is placed on the first portion of the buffer material. The insulation material may have a variety of configurations based on need. One example configuration is an insulation material array.

Upon placement of the insulation material, the preceding steps are repeated in reverse order. After an application of the bonding material on the insulation material, a second portion of the buffer material is placed on the insulation material, which is followed by another application of the bonding material and a second portion of the external layer. With each layer in place, a membrane is placed over the layers and secured to the staging area in an airtight fashion. A vacuum is drawn for a predetermined amount of time, and then released, thereby resulting in a unitized container panel.

Optionally, heating sources may be placed on multiple sides of the stacked layers to facilitate bonding of the layers. Further, reinforcement layers could be placed between the buffer material and the insulation material during assembly if the extra support is needed.

Constructed Unitized Container Panel Alternate Example

Figure 3:
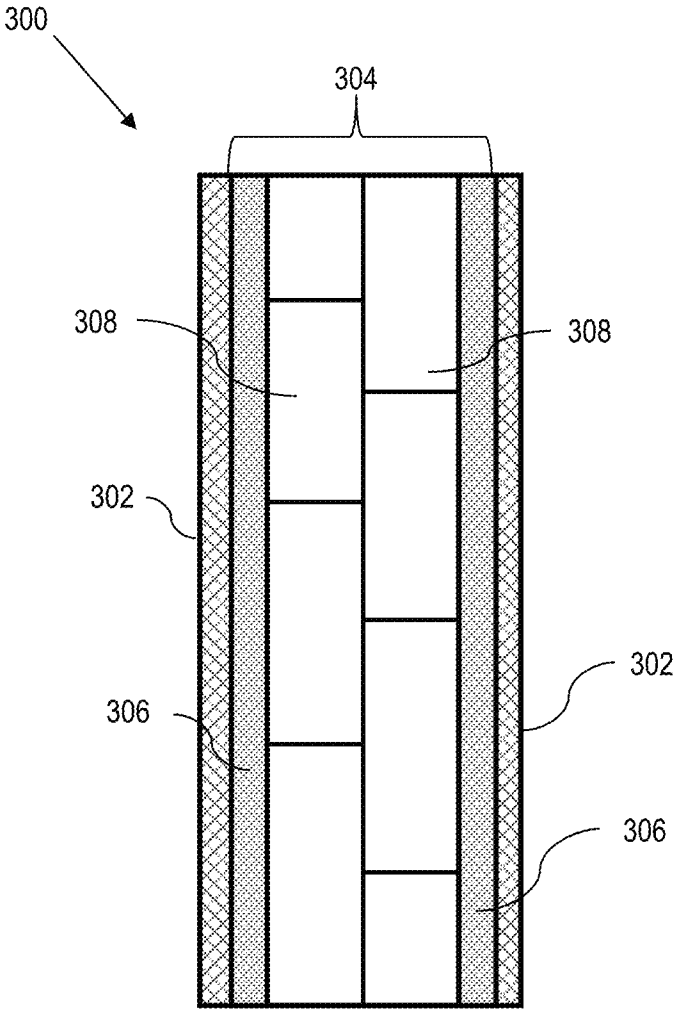
FIG. 3 is a side cross sectional view of an example embodiment of a unitized container panel made from the process in FIG. 1 according to various aspects of the present disclosure.

FIG. 3 is a side cross sectional view of an example embodiment of an assembled unitized container panel made from the process in FIG. 1, according to various aspects of the present disclosure. The structures in FIG. 3 are analogous to the structures in FIG. 2, and as such, like elements are referenced with like reference numbers except that the reference numbers are 100 higher. As such, references and embodiments related to FIGS. 1 and 2 are incorporated by analogy.

In the example embodiment illustrated by FIG. 3, the assembled unitized container panel comprises opposing external layers 302, and an intermediate layer 304. The intermediate layer 304 is comprised of a buffer material 306 and insulation material 306. In multiple configurations, the insulation material 308 (i.e., the VIPs) is arranged as an insulation material array.

FIG. 3 illustrates an example embodiment where the insulation material array is two layers of the insulation material, wherein each layer is offset from one another. Different insulation array configurations may be used based on amount of insulation needed. As such, tiled (staggered) rows (e.g., two or more) or insulating material (VIP, aerogel, etc.) are utilized.

Container Constructed Using Unitized Container Panels

According to aspects of the present disclosure, a unitized container 400 is disclosed. The unitized container 400 comprises a set of panels including a front panel, a roof panel, a right side panel, a left side panel, a floor panel, and a rear panel.

Figure 4A:
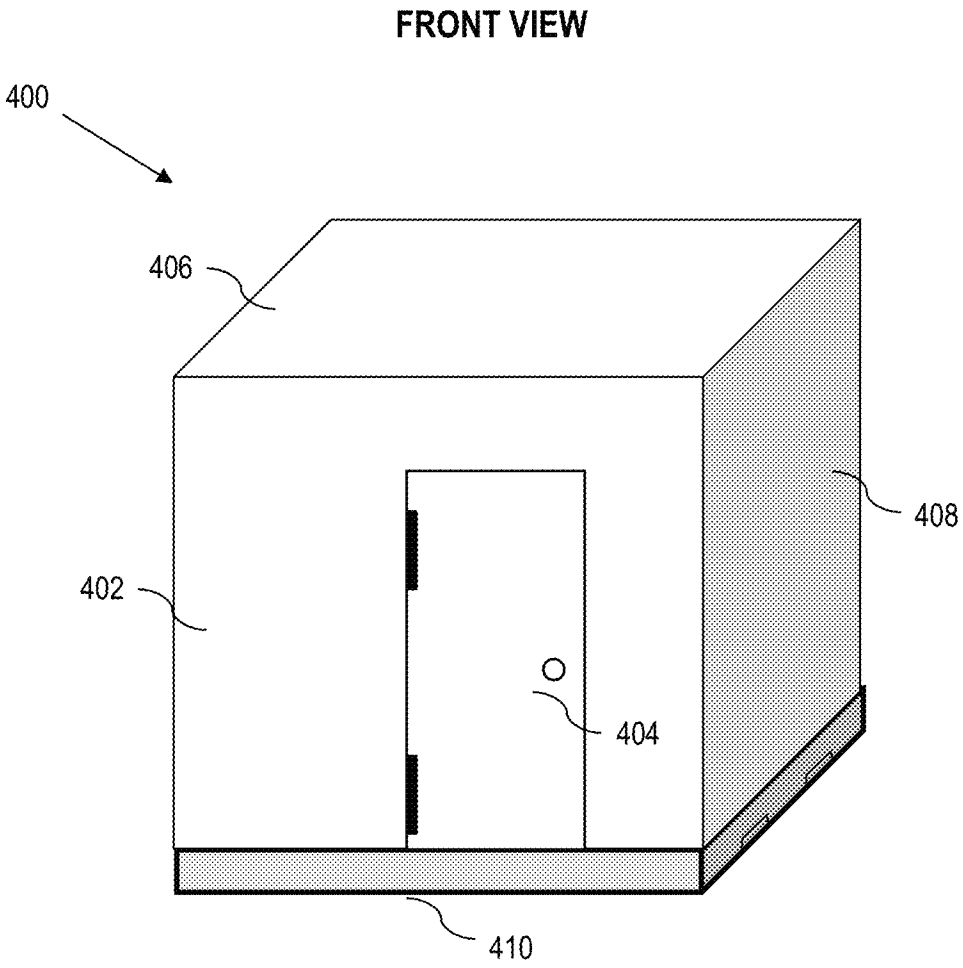
FIG. 4A is a front view of an example embodiment of a unitized container according to various aspects of the present disclosure.

FIG. 4A is a front view of an example embodiment of the unitized container 400. FIG. 4A illustrates the front panel 402 having an access point 404 into an interior space of the unitized container. In practice, the access point 404 can be positioned in any of the panels. Moreover, there can be more than one access point 404. FIG. 4A also illustrates the roof panel 406, the right side panel 408, and the floor panel 410.

Figure 4B:
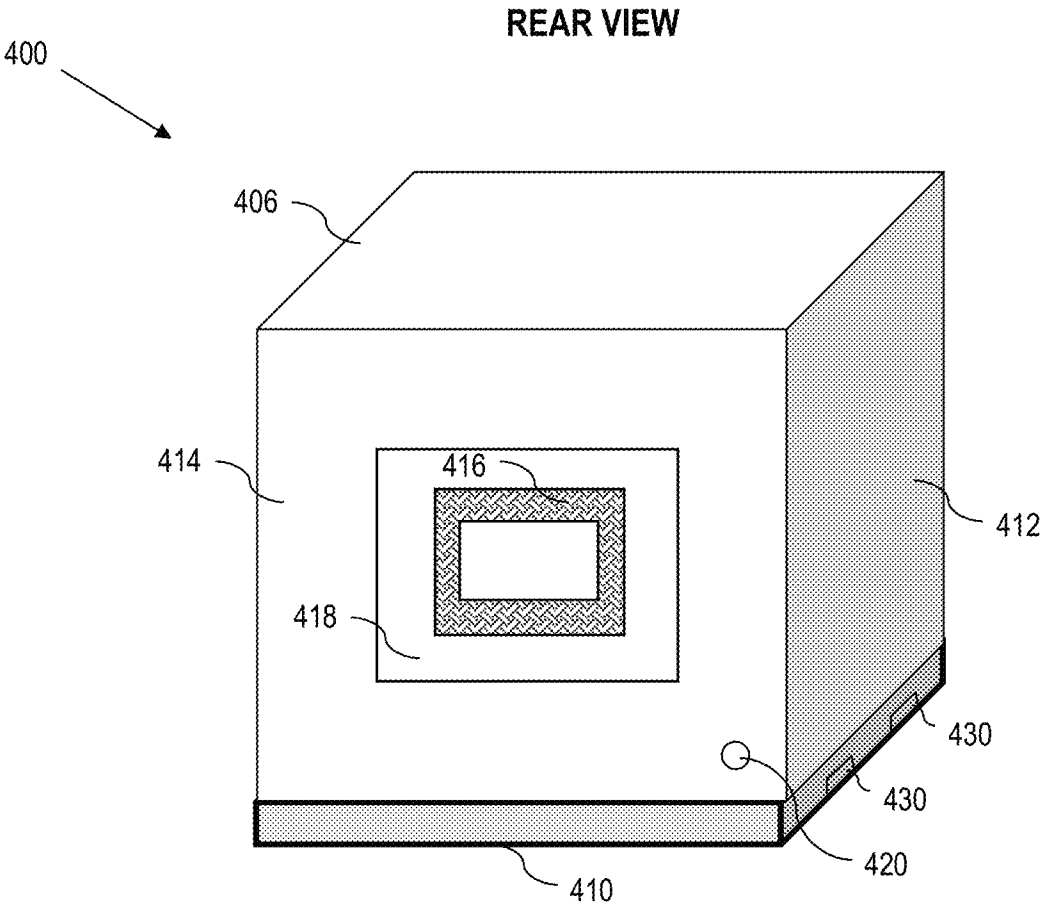
FIG. 4B is a rear view of an example embodiment of the unitized container of FIG. 4A according to various aspects of the present disclosure.

FIG. 4B is a rear view of the example embodiment of the unitized container 400 in FIG. 4A, which illustrates the roof panel 406, the left side panel 412, the floor panel 410, and the rear panel 414.

In various embodiments, the unitized container 400 further comprises an environmental modulation unit 416 that is coupled to a select one panel of the set of panels (the rear panel 414 in this example), and a shroud 418 between the environmental modulation unit 416 and the select one panel (rear panel 414 in this example).

In this regard, a power inlet 420 that receives a power source (not shown) that supplies energy to the environmental modulation unit 416 may be implemented. The power source comprises at least one of a microgrid, a battery, local power, short power, a solar powered mechanism, and a wind powered mechanism. The power inlet 420 may be placed virtually anywhere on the unitized container 400 (e.g., on the rear panel 414, built into the floor panel 410, the shroud 418, or the environmental modulation unit 416).

Referring to FIGS. 4A and 4B generally, in the illustrated example, when the unitized container is assembled, the floor panel 410 defines a floor surface; the front panel 402 is assembled to the floor panel 410 such that an edge thereof is orthogonal to a first edge of the floor panel 410; the right side panel 408 is assembled to the floor panel 410 such that an edge thereof is orthogonal to a second edge of the floor panel 410; the rear panel 414 is assembled to the floor panel 410 such that an edge thereof is orthogonal to a third edge of the floor panel 410; the left side panel 412 is assembled to the floor panel 410 such that an edge thereof is orthogonal to a fourth edge of the floor panel 410; and the roof panel 406 defines a roof surface and is coupled to the front panel 402, the right side panel 408, the rear panel 414, and the left side panel 412.

In various embodiments, at least one of the floor panel 410, roof panel 406, front panel 402, right side panel 408, rear panel 414, and left side panel 412 of the unitized container 400 is comprised of a unitized container panel assembled according to the process 100 for fabricating a unitized container panel. That is, at least one panel in the set of panels comprises a multilayer insulated panel comprising opposing external layers encasing an intermediate layer therebetween to form a unitized container panel, the intermediate layer comprising a vacuum insulation material and a buffer material encasing the vacuum insulation material. In certain embodiments, all of the panels that comprise the unitized structure for a container panel as described more fully herein.

In such embodiments, the unitized container panel can comprise external fiberglass layers and an intermediate layer, the intermediate layer comprising an insulation material comprising at least one of a vacuum insulated panel (VIP) and an aerogel, and a buffer material encasing the insulation material. In other implementations, at least one panel of the unitized container is comprised of a phase change material.

In certain implementations, the unitized container 400 can comprise a permanently assembled container structure. In this regard, corner columns, edge blocks, other structures, combinations thereof, etc., can be used for (e.g., to facilitate stacking, storing, etc.) such containers.

In alternative embodiments, the unitized container 400 can comprise hinges, locks, clasps, other structures, or combinations thereof to assemble and disassemble the structure. Moreover, the floor can have a thickness that includes "pallet slots" 430 so that a standard forklift can pick up and move the container. In some embodiments, a container 400 can be 8'×8'×8' (approximately 2.44 meters×approximately 2.44 meters×approximately 2.44 meters) or greater in one or more dimensions.

Figure 5:
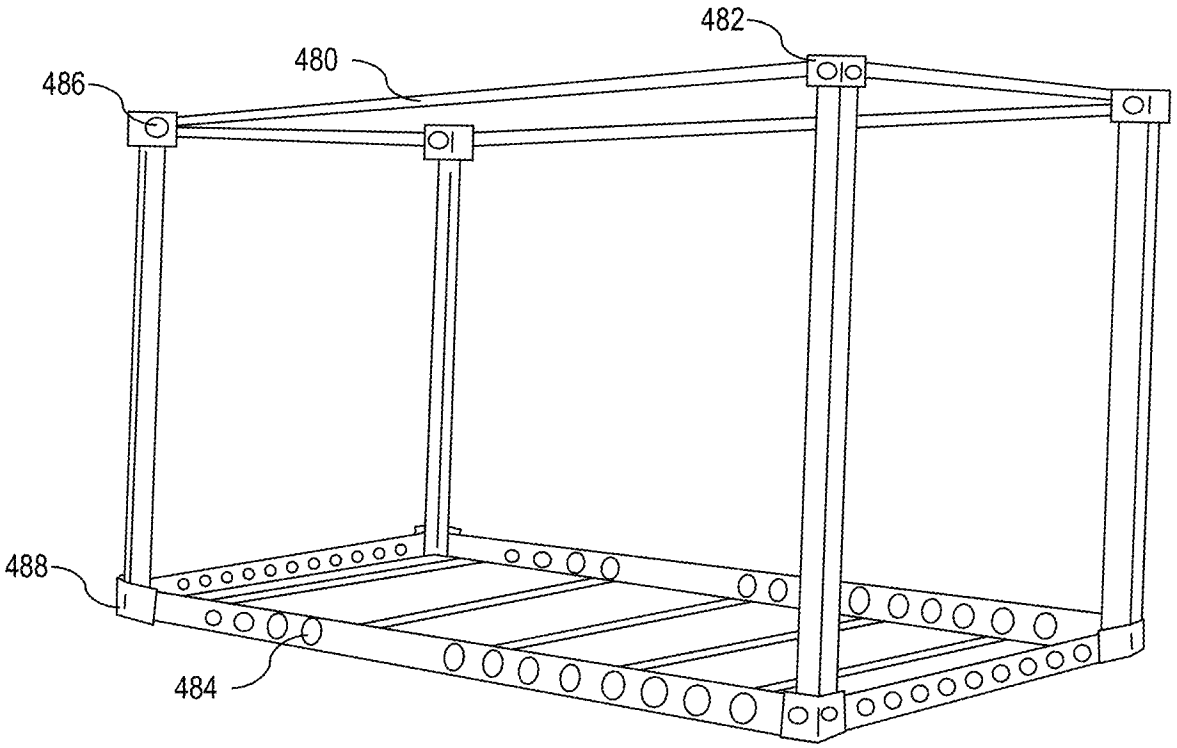
FIG. 5 is a perspective view of a rigid steel frame for the unitized container of 4A according to various aspects of the present disclosure.

Now referring to FIG. 5, in various embodiments, the unitized container 400 is comprised of a rigid frame 480 (interchangeable with wire frames and space frames) and an optional set of stacking members 482 disposed on each corner of the rigid frame 480.

In some embodiments, the rigid frame 480 defines a rigid frame (or space frame). For the purposed of this disclosure, a rigid frame is a structural frame that is generally comprised of support members disposed between corners of the container structure. For instance, a rigid frame does not need to include a series of spaced wall studs. Rather, there are four vertical columns (e.g., steel frame beams) that connect each corner. Moreover, there are four horizontal columns (e.g., steel frame beams) that connect each corner. It may be desirable in certain implementations to include spaced floor supports however.

One advantage of the rigid frame 480 is that the material strength of rigid material (e.g., steel) may allow the unitized container 400 to withstand the weight load of another container being stacked onto the unitized container 400 (e.g., a second unitized container). To that end, the stacking members 482 provide a structure that other containers may use to stack onto the unitized container 400. One example of a stacking member is an ISO block. ISO blocks are solid structures, which are typically square or rectangular in shape, with predefined openings configured to accept various implements (e.g., a twist lock).

Moreover, the rigid frame 480 can accommodate a variety of spatial dimensions (e.g., e.g., lengths of 40 feet (approximately 12.2 meters), 20 feet (approximately 6.1 meters), 10 feet (approximately 3.05 meters), 6 feet 8 inches (approximately 2.03 meters), 5 feet (approximately 1.5 meters), etc.) due in part to the inherent flexibility of the unitized panels disclosed and described herein, which can be fabricated to nearly any size in one piece, a solid container can be constructed with minimal individual panels (e.g., a container of virtually any reasonable size) can be constructed from six panels.

Moreover, the unitized panels can be bonded directly to the rigid frame 480. The bonding of the panels to the rigid frame 480 can be carried out even for a rigid frame (i.e., a frame without traditional cross posts or wall studs although floor cross posts may be used as illustrated in FIG. 5).

One advantage of using a rigid frame (as opposed to traditional framing with spaced wall studs) is that the rigid frame is generally lighter in weight. Due to the mobile nature of the unitized container 400, the overall weight of the unitized container 400 can be a significant factor during frequent or prolonged transports. The weight of the rigid frame 480, and the unitized container 400 by extension, can be further reduced by implementing lightening holes 484 (e.g., drilling holes into the rigid frame to further reduce weight). Additionally, the rigid properties of the unitized panels disclosed and described herein may further support the rigid frame 480.

Moreover, the rigid frame 480 may further comprise lifting rings 486 on a top portion of the rigid frame, and tie downs 488 on a bottom portion of the rigid frame. The lifting rings 486 allow for easier movement of the rigid frame 480 (e.g., using a helicopter), and the tie downs 488 provider further positional security.

Referring to FIGS. 4A, 4B, and 5, the environmental modulation unit 416 enables the container to function as a refrigeration unit, freezer, etc. In this regard, the unitized panels provide a container that exhibits superior insulating capability (e.g., because of the combination of high insulating characteristics and minimal number of joints). Moreover, corners, unions, joints, etc., can be further sealed to improve thermal characteristics. Mover, by bonding unitized panels to a rigid frame 480 (e.g., a steel frame) the thermal properties can be improved by providing a well-sealed structure.

In this regard, a unitized container is provided according to certain aspects of the present disclosure, having a frame (e.g., rigid frame) that forms the edges of a container, and a set of panels including a front panel, a roof panel, a right side panel, a left side panel, a floor panel, and a rear panel.

Under this configuration, the floor panel defines a floor surface bonded to a floor portion of the frame (e.g., four frame members that form a generally horizontal plane towards the bottom of the container). The front panel is bonded to a front portion of the frame (e.g., four frame members that form a generally vertical plane towards the front of the container, orthogonal to the floor portion).

The right side panel is bonded to a right side portion of the frame (e.g., four frame members that form a generally vertical plane towards the right side of the container, orthogonal to the floor portion and orthogonal to the front portion).

The rear panel is bonded to a rear portion of the frame (e.g., four frame members that form a generally vertical plane towards the rear of the container parallel to the front portion).

The left side panel is bonded to a left side portion of the frame (e.g., four frame members that form a generally vertical plane towards the left side of the container, parallel to the right side portion), and the roof panel defines a roof surface bonded to a roof portion of the frame (e.g., four frame members that form a plane towards the top of the container).

The container in this example also comprises an environmental modulation unit that is coupled to a select one panel of the set of panels, a shroud between the environmental modulation unit and the select one panel, and a power inlet that receives a power source that supplies energy to the environmental modulation unit, the power source comprising at least one of a microgrid, a battery, local power, short power, a solar powered mechanism, and a wind powered mechanism.

At least one panel in the set of panels comprises a multilayer insulated panel comprising opposing external layers encasing an intermediate layer therebetween to form a unitized container panel, the intermediate layer comprising an insulation material and a buffer material encasing the insulation material. Moreover, at least one panel in the set of panels comprises an access point (e.g., door) into an interior space of the unitized container (e.g., for ingress/egress).

Expandable Container

Referring generally to FIG. 6 through FIG. 16, a container can also be "expandable" according to aspects of the present disclosure herein. Although an expandable container can take on various forms, for sake of clarity and discussion herein, a non-limiting example is provided in the form of an expandable tricon having expandable container sections on opposite sides of a main container body.

Figure 6:
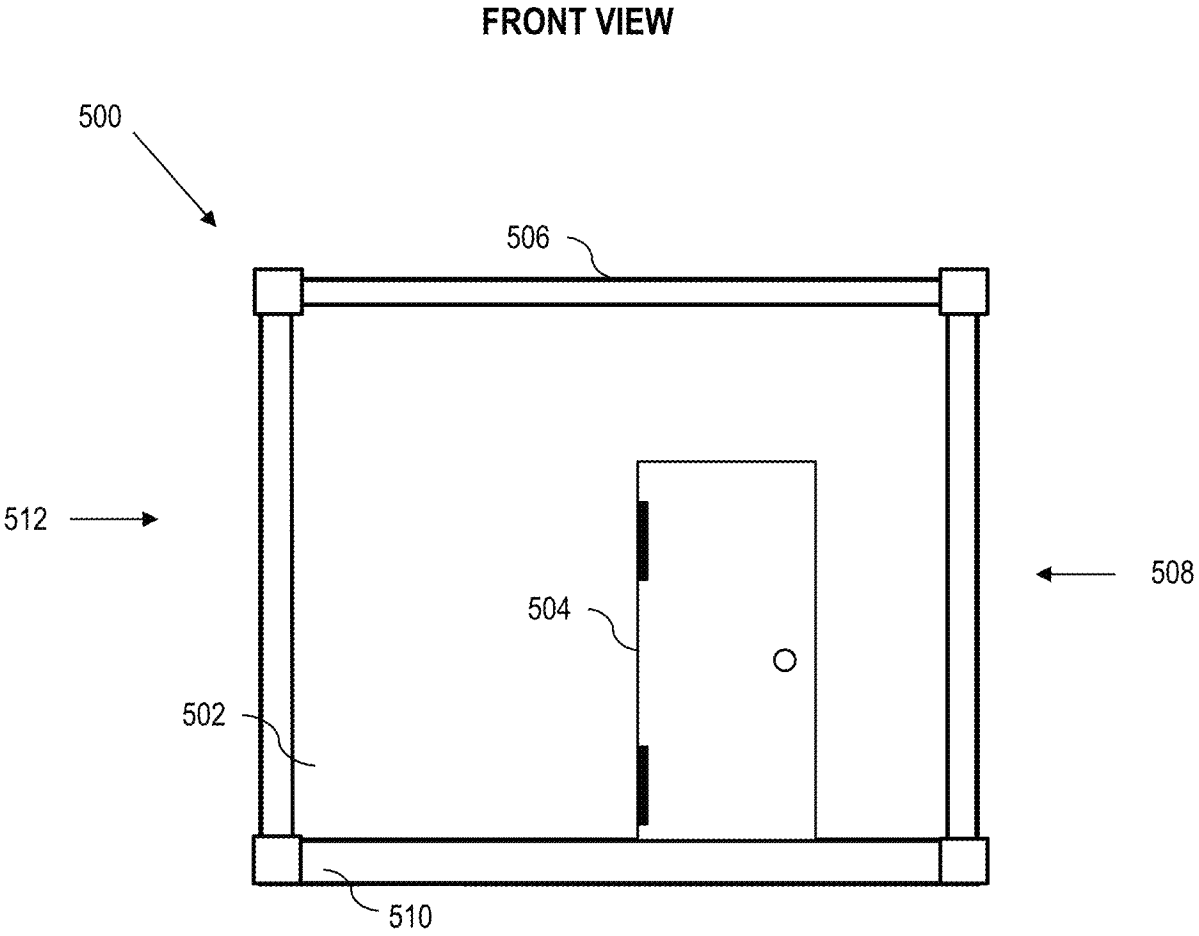
FIG. 6 is a front view of an example embodiment of an expandable container, illustrating a front panel of the expandable container in a non-expanded form, according to various aspects of the present disclosure.

FIG. 6 illustrates an expandable container 500 in its starting or "compact" (i.e., non-expanded) configuration. The compact configuration, in many cases, is the configuration that the expandable container 500 will remain in during travel. In various embodiments, the expandable container 500 in the compact configuration houses most, if not all parts necessary to transition the expandable container 500 from the compact configuration, to a deployed configuration. FIGS. 6-16 illustrate a gradual progression of the expandable container 500 from the compact configuration to the deployed configuration. Variations and alternate embodiments are noted therein.

Because the expandable container is a variation of the fixed container, like elements analogous to the counterpart elements in FIG. 4 are indicated with like reference numbers 100 higher. Moreover, embodiments associated with fixed container and expandable container are interchangeable where practical.

According to aspects of the present disclosure, an expandable container 500 is disclosed. As illustrated, the expandable container 500 in FIG. 6 comprises a main container body having a front panel 502. As with other examples herein, the container 500 can have an access point 504 therein, which is suitable for ingress and egress. In practice, the access point 504 can be positioned on many of the panels. Moreover, there can be more than one access point. FIG. 6 also illustrates a roof panel 506, a right side panel 508, a floor panel 510, and a left side panel 512. The floor panel 510 serves as a floor (or foundation) for the expandable container 500.

Figure 7:
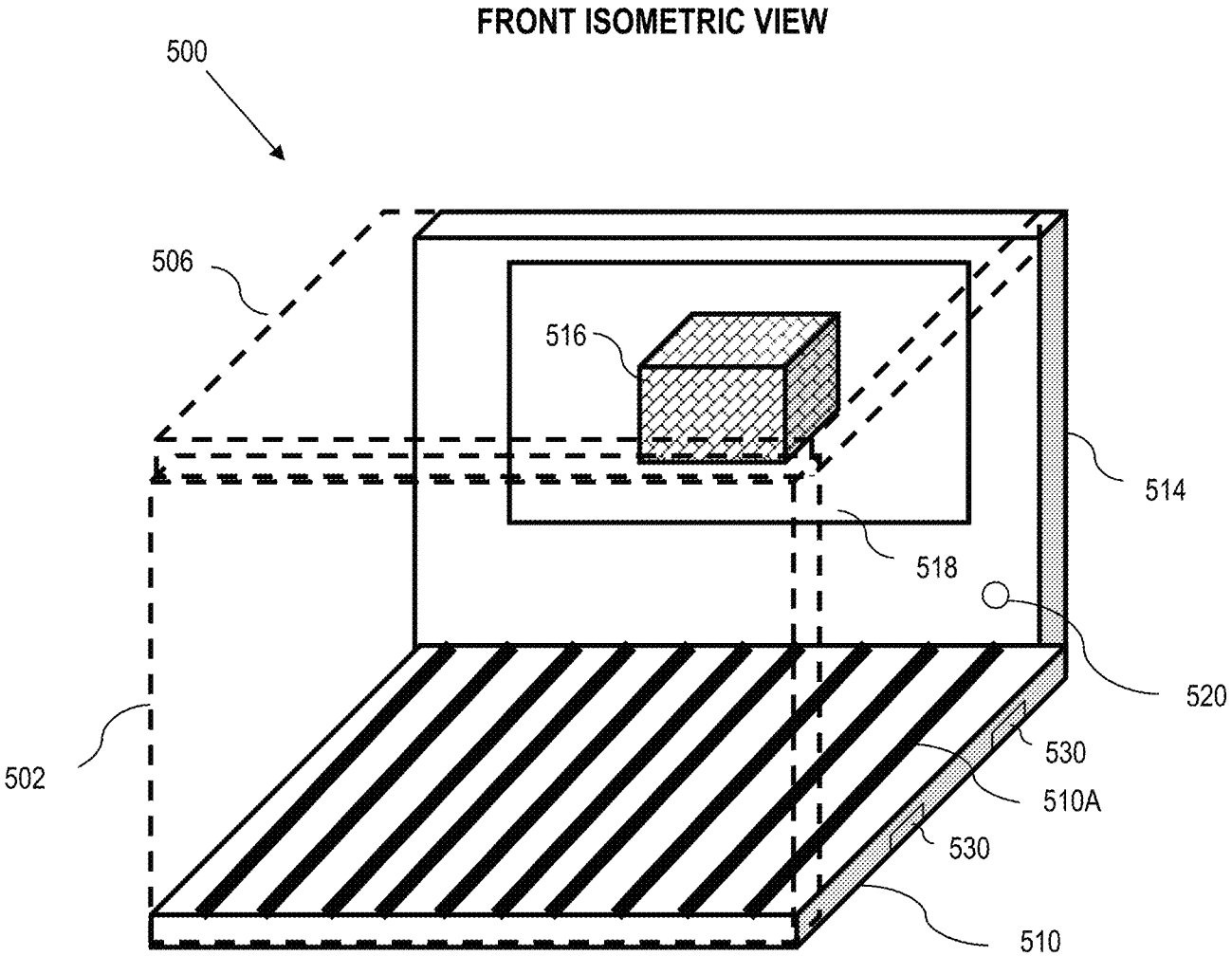
FIG. 7 is a front isometric cutaway view of the expandable container of FIG. 5, according to various aspects of the present disclosure.

Now referring to FIG. 7, which is a front isometric view of the expandable container 500, wherein the expandable container 500 further comprises a roof panel 506 that is adjacent to the front panel 502 and oppositely positioned to the floor panel 510. In various embodiments, the roof panel 502 has a slight pitch (not shown) to allow for water runoff.

In various embodiments, the floor panel 510 comprises a plurality of extrusions 510A, which can be used as an attachment point for equipment or other components of the expandable container 500. The extrusions 510 (or ribs) can also be provided to allow air flow.

Further, the expandable container 500 comprises a rear panel 514, which is positioned opposite of the front panel 502.

In various embodiments, at least one of the floor panel 510, roof panel 506, front panel 502, right side panel 508, rear panel 514, and left side panel 512 of the container 500 is comprised of a unitized container panel assembled according to the process 100 for fabricating a unitized container panel. As will be described in greater detail herein, the expandable container 500 also comprises one or more sets of expansion panels (two sets in this illustrative example).

Here, any of the expansion panels can also be fabricated according to the process of FIG. 1. That is, at least one panel (and optionally all panels) in the set of panels comprises a multilayer insulated panel comprising opposing external layers encasing an intermediate layer therebetween to form a unitized container panel, the intermediate layer comprising an insulation material and a buffer material encasing the insulation material. In certain embodiments, all of the panels comprise the unitized structure for a container panel as described more fully herein.

In such embodiments, the unitized container panel can comprise external fiberglass layers and an intermediate layer, the intermediate layer comprising an insulation material comprising at least one of a vacuum insulated panel (VIP) and an aerogel, and a buffer material encasing the insulation material. In other implementations, at least one panel of the unitized container is comprised of a phase change material. A phase change material (PCM) can be utilized to level a thermal load (e.g., to stabilize the material).

In various embodiments, the expandable container 500 may comprises an environmental modulation unit 516 that is coupled to a select one panel of the set of panels (the rear panel 514 in this example), and a shroud 518 between the environmental modulation unit 516 and the select one panel (rear panel in this example). Examples of an environmental modulation unit include, but is not limited to an air conditioning (A/C), a heating unit, etc.

In further embodiments, the container 500 can also comprise a power inlet 520 that receives a power source that supplies energy to the environmental modulation unit 516. The power source comprises at least one of a microgrid, a battery, a solar powered mechanism, and a wind powered mechanism. The power inlet 520 may be placed anywhere on the container 500 (e.g., on the rear panel 514, built into the floor panel 510, the shroud 518, or the environmental modulation unit 516).

In such embodiments, the unitized container 500 herein provides significant benefits over other container/shelters. For instance, because of the superior insulation as set out herein, a smaller environmental modulation unit 516 can be used to achieve a comparable temperature compared to a conventional container/shelter. Moreover, by utilizing less energy (due to superior insulating panels), the environmental modulation unit 516 consumes relatively less power, providing significant savings, especially when deployed in hostile environments. Moreover, as will be described herein, the expandable container configuration enables multiple temperature zones (e.g., to implement a refrigeration area and a freezer area, etc.).

Moreover, the floor can have a thickness that includes "pallet slots" 530 so that a standard forklift can pick up and move the container 500. In this regard, a container 500 can be 8'×8'×8' (approximately 2.44 meters×approximately 2.44 meters×approximately 2.44 meters) in the non-expanded configuration.

In certain embodiments, an expandable container can have at least a first set of expansion panels (see FIG. 8 below). The first set of expansion panels comprise an expansion roof panel that transitions from a stowed position within the main container body outward to correspond with the main roof panel. The first set of expansion panels also comprises an expansion wall panel that transitions from a stowed position within the main container body outward to form a first expansion wall panel.

The first set of expansion panels further comprises an expansion compound panel, which includes a first swing panel, and a second swing panel. The expansion compound panel transitions from a stowed position within the main container body outward such that the first swing panel forms a second expansion wall panel opposite the first expansion wall panel, and the second swing panel forms a side expansion wall panel that couples between the first expansion wall panel and the second expansion wall panel.

The first set of expansion panels yet further comprises an expansion floor panel that transitions from a stowed position within the main container body outward to form a floor when the first set of expansion panels is expanded.

The expandable container also comprises a plurality of locking members that facilitate fastening of the first set of expansion panels to one another, and a plurality of couplers that facilitate transitioning of the first set of expansion panels from their stowed position to a deployed position.

At least one panel of the first set of expansion panels comprises a multilayer insulated panel comprising opposing external layers encasing an intermediate layer therebetween to form a unitized container panel, the intermediate layer comprising an insulation material and a buffer material encasing the insulation material.

Figure 8:
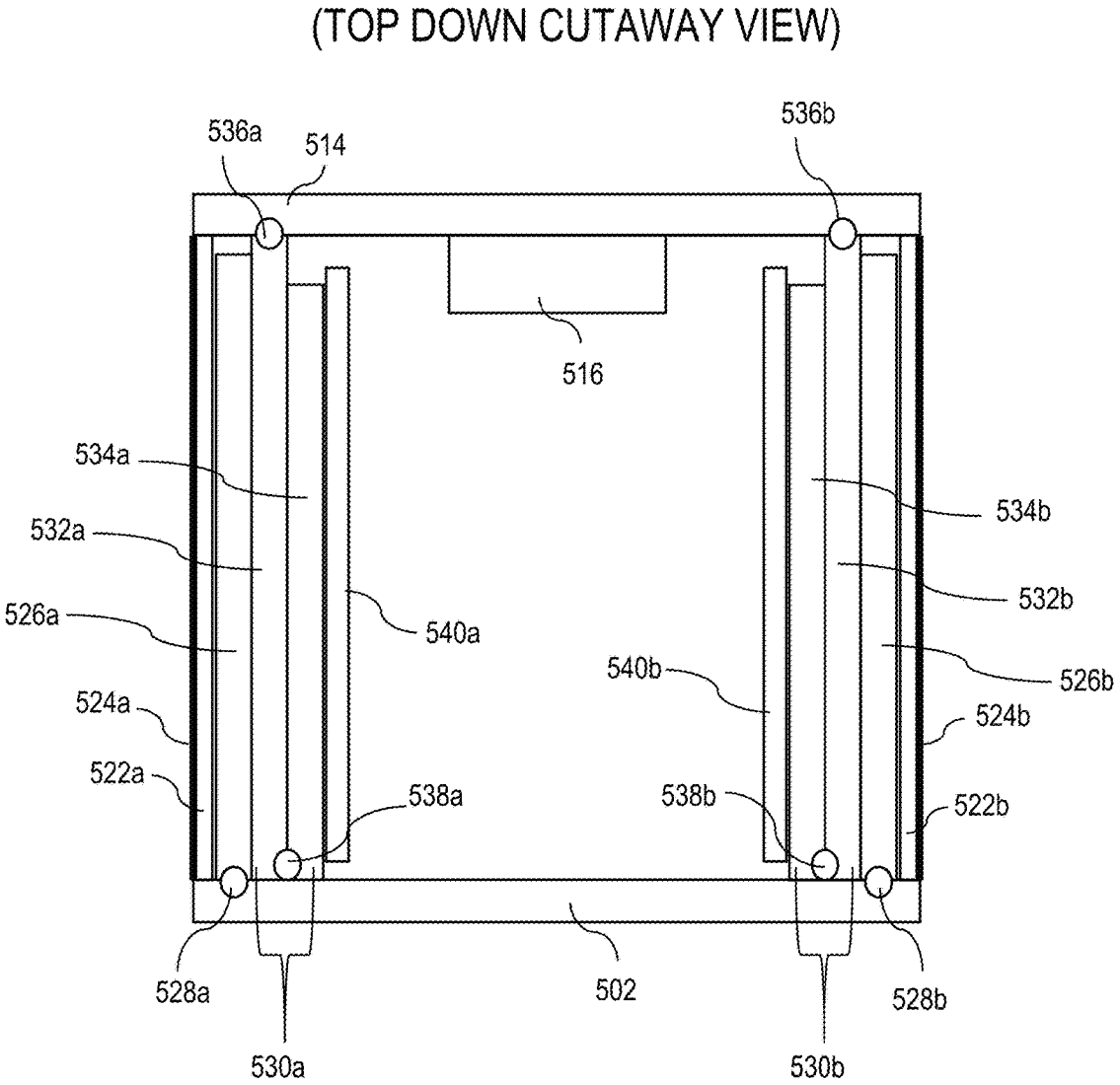
FIG. 8 is a top down cutaway view of the expandable container of FIG. 6, illustrating the expandable panels in a stored position, according to various aspects of the present disclosure.

By way of illustration, FIG. 8 is a top down cutaway view of the expandable container 500 in the stowed position, wherein the expandable container 500 comprises set(s) of expansion panels.

With respect to the set(s) of expansion panels, more than one set of expansion panels may be used. In the subsequent figures relating to this one potential expandable container 500, two identical and symmetrical sets of expansion panels are illustrated. For clarity, the sets of expansion panels will share the same reference numbers, except that each set will be labeled as a first set of expansion panels "a" and a second set of expansion panels "b" respectively.

The container 500 comprises a first expansion roof panel 522*a* that is coupled to the left side panel via a suitable coupler (e.g., a hinge 524*a*). Likewise, a second expansion roof panel 522*b* is coupled to the right side panel via a suitable coupler (e.g., a hinge 524*b*). In some embodiments, the first expansion roof panel 522*a* forms (at least part of) a left side panel of the base container when in a stowed position. Likewise, the second expansion roof panel 522*b* forms (at least part of) a right side panel of the base container when in a stowed position.

Working inward from the expansion roof panel 522*a*, the expandable container 500 comprises a first expansion front panel 526*a* adjacent to the first expansion roof panel 522*a*. The first expansion front panel 526*a* is coupled to an inside surface of the main container body via a first expansion front coupler (e.g., front hinge 528*a*). Analogously, the expandable container 500 comprises a second expansion front panel 526*b* adjacent to the second expansion roof panel 522*b*. The second expansion front panel 526*b* is coupled to an inside surface of the main container body via a second expansion front coupler (e.g., front hinge 528*b*).

Yet further, the expandable container 500 comprises a first expansion compound panel 530*a* stored adjacent to the first expansion front panel 526*a*. The first expansion compound panel 530*a* comprises a first rear swing panel 532*a*, and a first side swing panel 534*a*. As illustrated, the first expansion compound panel 530*a* is coupled to an inside surface of the main container body via a first expansion compound coupler (e.g., compound coupler hinge 536*a*). Also, the first rear swing panel 532*a* is coupled to the first side swing panel 534*a* (e.g., via coupling hinge 538*a*).

Likewise, the expandable container 500 comprises a second expansion compound panel 530*b* stored adjacent to the second expansion front panel 526*b*. The second expansion compound panel 530*b* comprises a second rear swing panel 532*b*, and a second side swing panel 534*b*. Analogously, the second expansion compound panel 530*b* is coupled to an inside surface of the main container body via a second expansion compound coupler (e.g., compound coupler hinge 536*b*). Also, the second rear swing panel 532*b* is coupled to the second side swing panel 534*b* (e.g., via coupling hinge 538*b*).

Moreover, the expandable container 500 comprises a first expansion floor panel 540*a* and a second expansion floor panel 540*b*.

In various embodiments, the mechanism that facilitates articulation of the expansion panels, is a plurality of hinges (see e.g., 524*a*, 524*b*, 528*a*, 528*b*, 536*a*, 536*b*, 538*a*, 538*b*, etc.). No particular type of hinge is required, but examples of acceptable hinges include bi-fold hinges, butt hinges, case hinges, conceal hinges, continuous hinges, flag hinges, slip joint hinges, overlay hinges, stop hinges, etc. In various embodiments, the hinges span the entire length of the of the corresponding panel to which the hinge is attached.

Figure 9A:
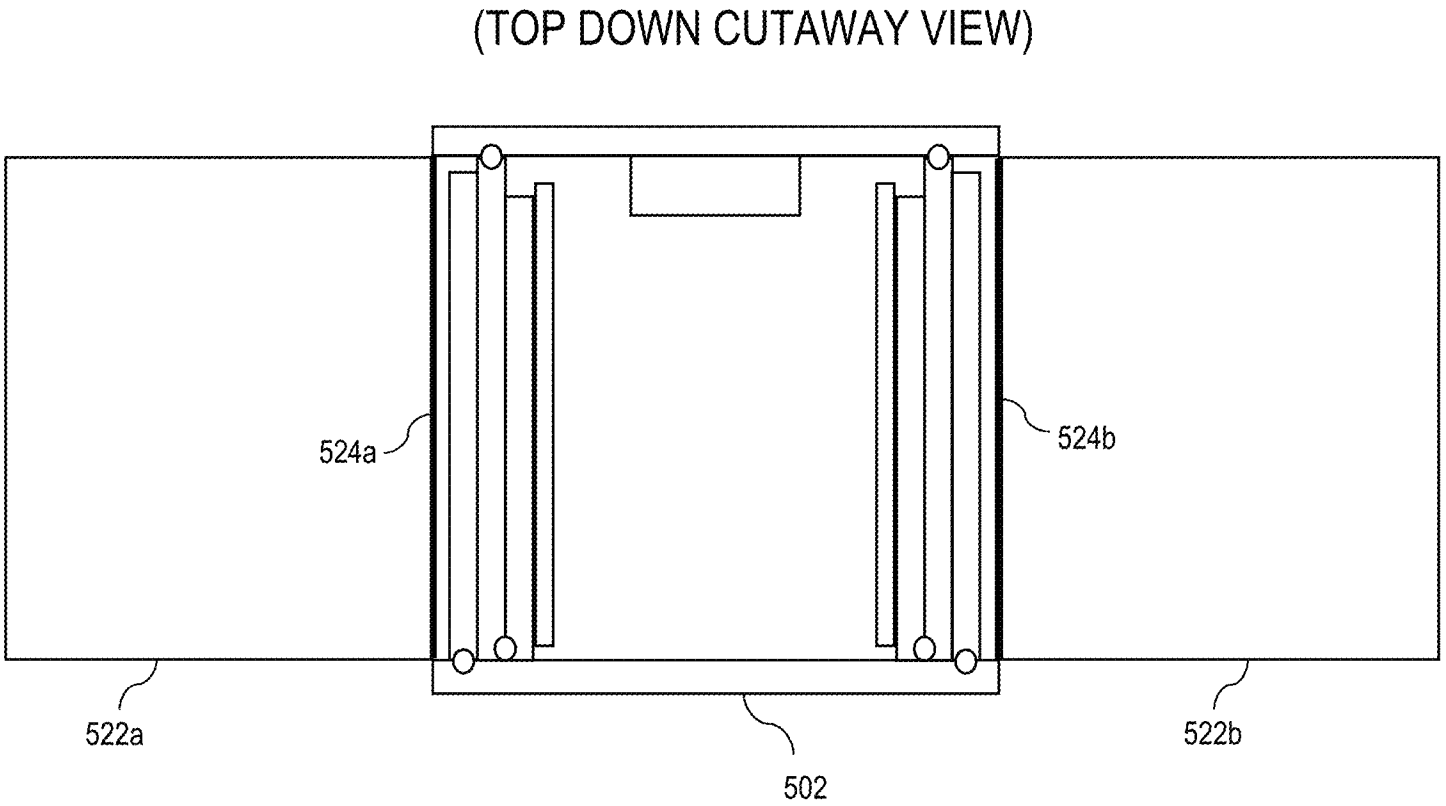
FIG. 9A is a top down cutaway view of the expandable container of FIG. 6, illustrating the deployment of expansion roof panels via a hinge according to various aspects of the present disclosure.

FIG. 9A illustrates the deployment of the expansion roof panels 522*a* and 522*b* via the hinges 524*a* and 524*b* respectively. For instance, the expansion roof panels 522*a* and 522*b* can be stowed locked to the main container body to form part of the left and right side panels respectively. The expansion roof panels 522*a* and 522*b* can thus be unlocked from the main container body and rotated into a roof position via the hinges 524*a* and 524*b* respectively.

Figure 9B:
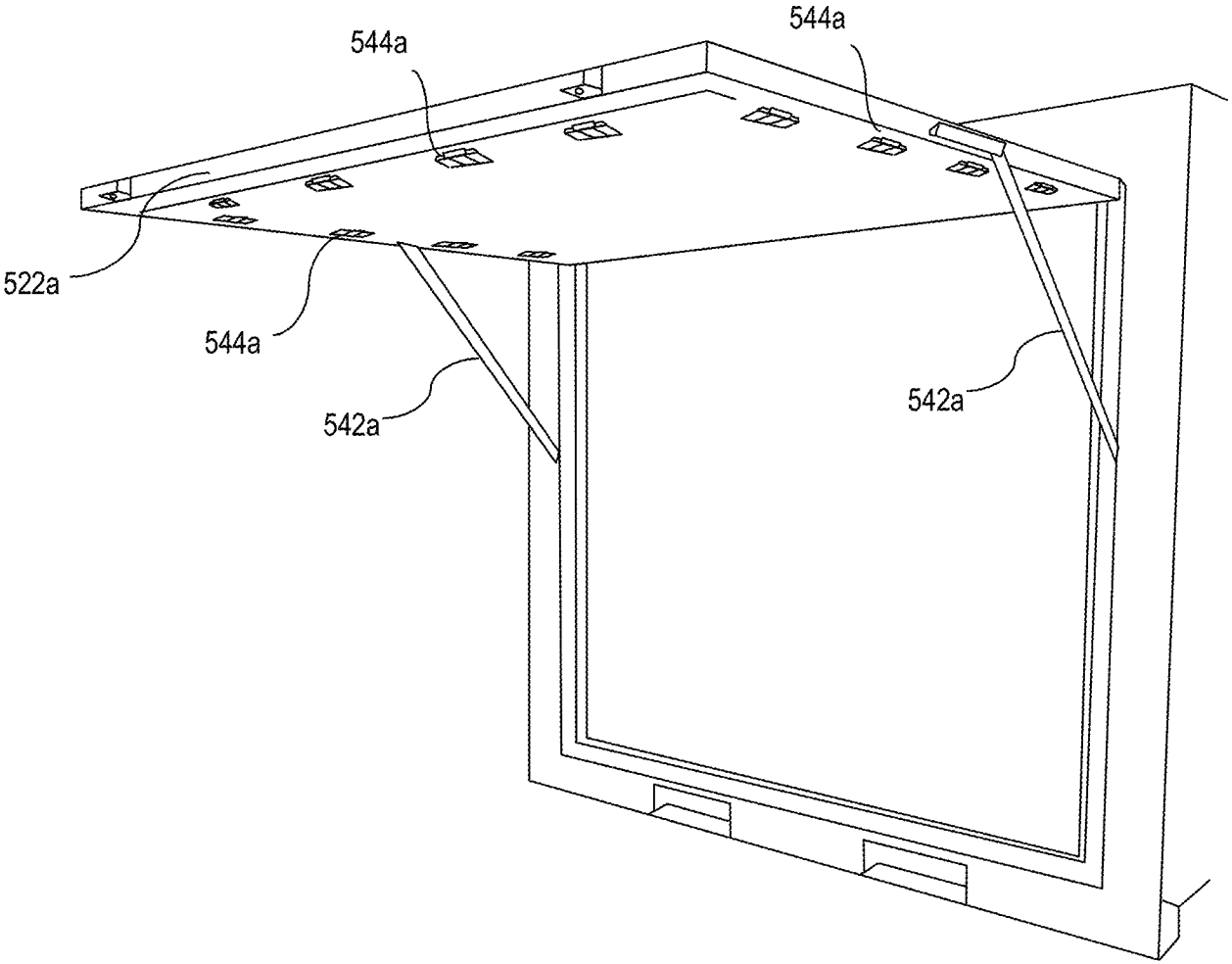
FIG. 9B is an isometric view of a section of the expandable container of FIG. 6 showing an expansion roof panel deployed according to aspects of the present disclosure.

Referring to FIG. 9B, the first expansion roof panel 522*a* is illustrated in a deployed position. In various embodiments, bracing members 542*a* are disposed between the expandable container 500 and the expansion roof panels (e.g., 522*a* as shown). Multiple types of bracing members may be used, such as a straight bar, an expansion bar (with or without a channel lock), a pneumatic lock, jointed hinge, hydraulic arm, combinations thereof, etc. For instance, gas springs can be used for lift-assist making deployment easier with a fewer number of people.

FIG. 9B also shows that on the inside surface of the expansion roof panel 522*a* are a series of locking mechanisms 544*a* that are distributed around the panel adjacent to the edges thereof. These locking mechanisms 544*a* facilitate locking the expansion roof panel 522*a* to corresponding expansion front, side, and rear panels. Examples of locking members include cam locks, lever locks, deadbolts, pad locks, recess locks (e.g., recessed catch point), mortise locks, etc. In practice, multiple may be used on one or more panels.

Figure 10A:
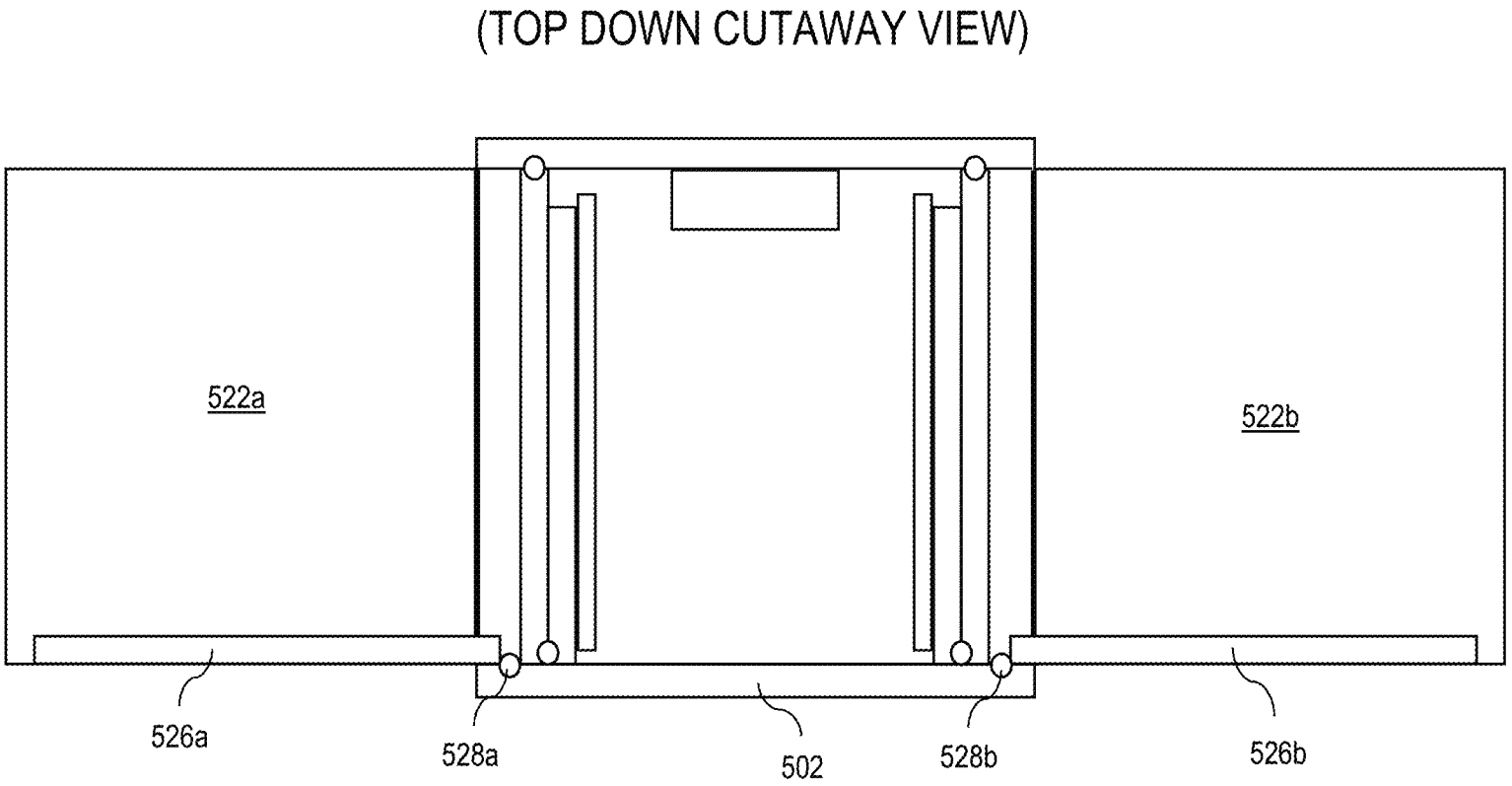
FIG. 10A is a top down cutaway view of the expandable container of FIG. 6, illustrating the deployment of expansion compound panels showing the formation of expansion front panels according to various aspects of the present disclosure.

FIG. 10A is a top down cutaway view of the expandable container 500, which illustrates the next step in deployment of the expandable sections of the container 500. As previously noted with regard to FIGS. 9A and 9B, the expansion roof panels are deployed. Next, as illustrated in FIG. 10A, the front expansion panels 526*a*, 526*b* are deployed. More particularly, the front expansion panel 526*a* is rotated via the front hinge 528*a* to rotate out and extend from the main container body and form a front (left front) expansion panel. Likewise, the front expansion panel 526*b* is rotated via the front hinge 528*b* to rotate out and extend from the main container body and form a front (right front) expansion panel.

Figure 10B:
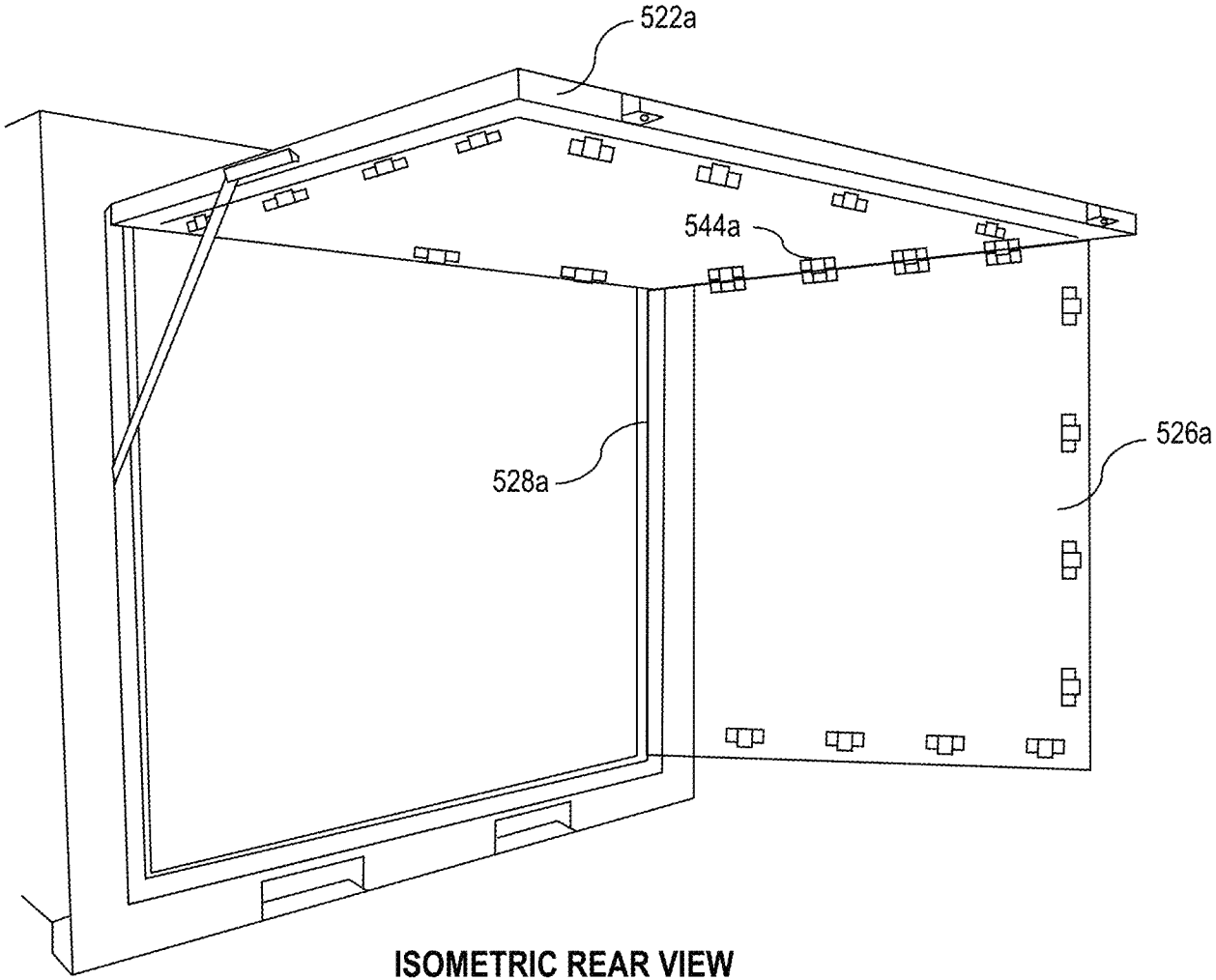
FIG. 10B is a perspective view of a section of the expandable container of FIG. 5 showing an expansion wall panel deployed according to aspects of the present disclosure.

Referring to FIG. 10B, an isometric view shows the front expansion panel 526*a* is rotated via the front hinge 528*a* to rotate out and extend from the main container body. The front expansion panel 526*a* has complimentary locking mechanisms 544*a* that align with and lock together with the corresponding locking mechanisms (not shown) on the expansion roof panel 522*a*. In this regard, complimentary locking mechanisms form a locking component and a receiving component.

An analogous procedure is implemented on the right hand side to lock the front expansion panel 526*b* to the expansion roof panel 522*b* (not shown).

Figure 11:
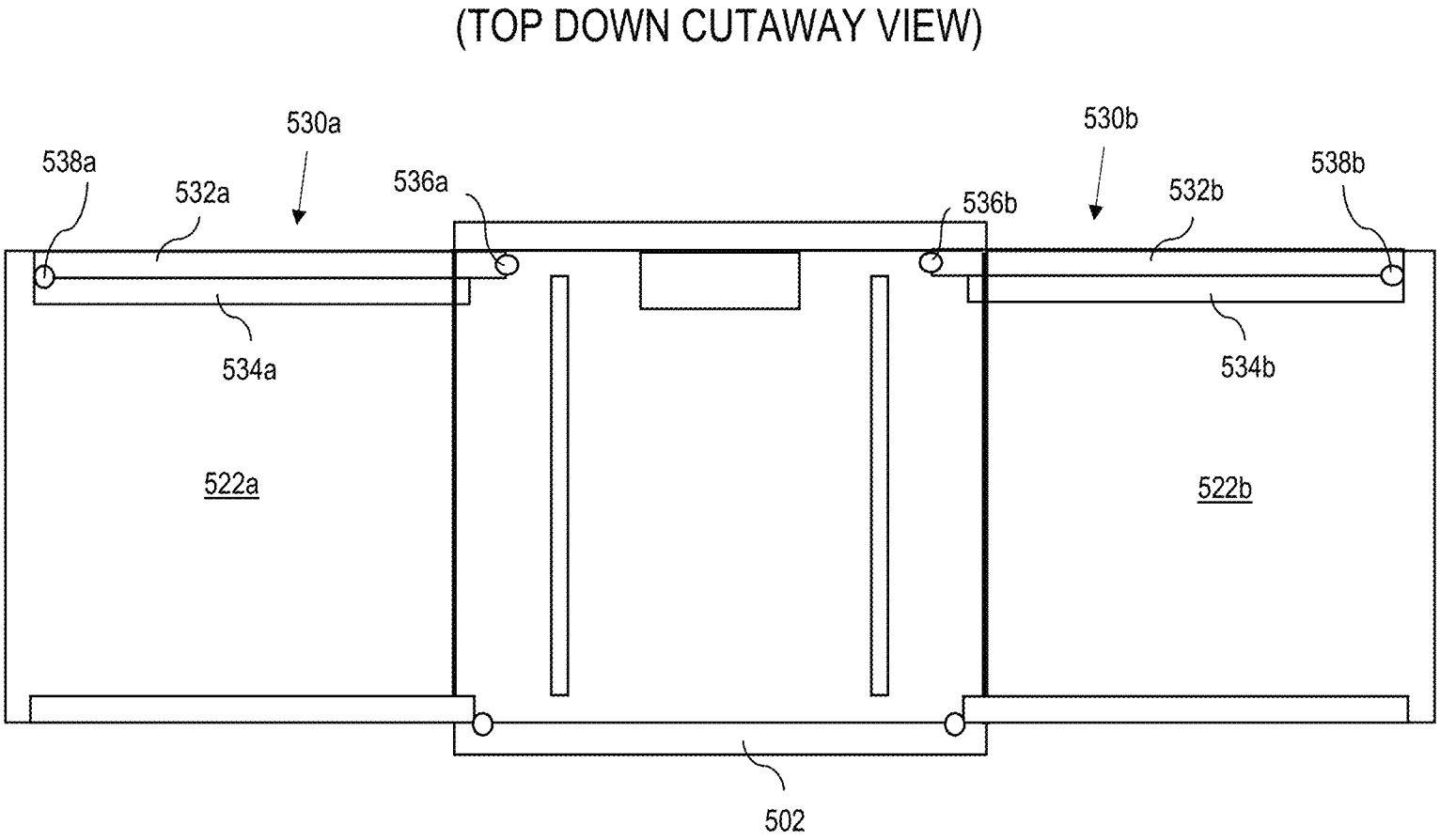
FIG. 11 is a top down cutaway view of the expandable container of FIG. 6, illustrating the deployment of expansion compound panels showing the formation of expansion rear panels according to various aspects of the present disclosure.

FIG. 11 is a top down cutaway view of the expandable container 500, which illustrates the next step in deployment of the expandable sections of the container 500. As illustrated, the first expansion compound panel 530*a* is rotated outward via the compound coupler hinge 536*a*. In this deployment, the first rear swing panel 532*a* of the first expansion compound panel 530*a* defines a rear expansion panel. In this example embodiment, the first rear swing panel 532*a* locks to the first expansion roof panel 522*a* using locking mechanisms as described more fully herein.

Analogously, the second expansion compound panel 530*b* is rotated outward via the compound coupler hinge 536*b*. In this deployment, the second rear swing panel 532*b* of the second expansion compound panel 530*b* defines a rear expansion panel. In this example embodiment, the second rear swing panel 532*b* locks to the second expansion roof panel 522 busing locking mechanisms as described more fully herein.

Figure 12:
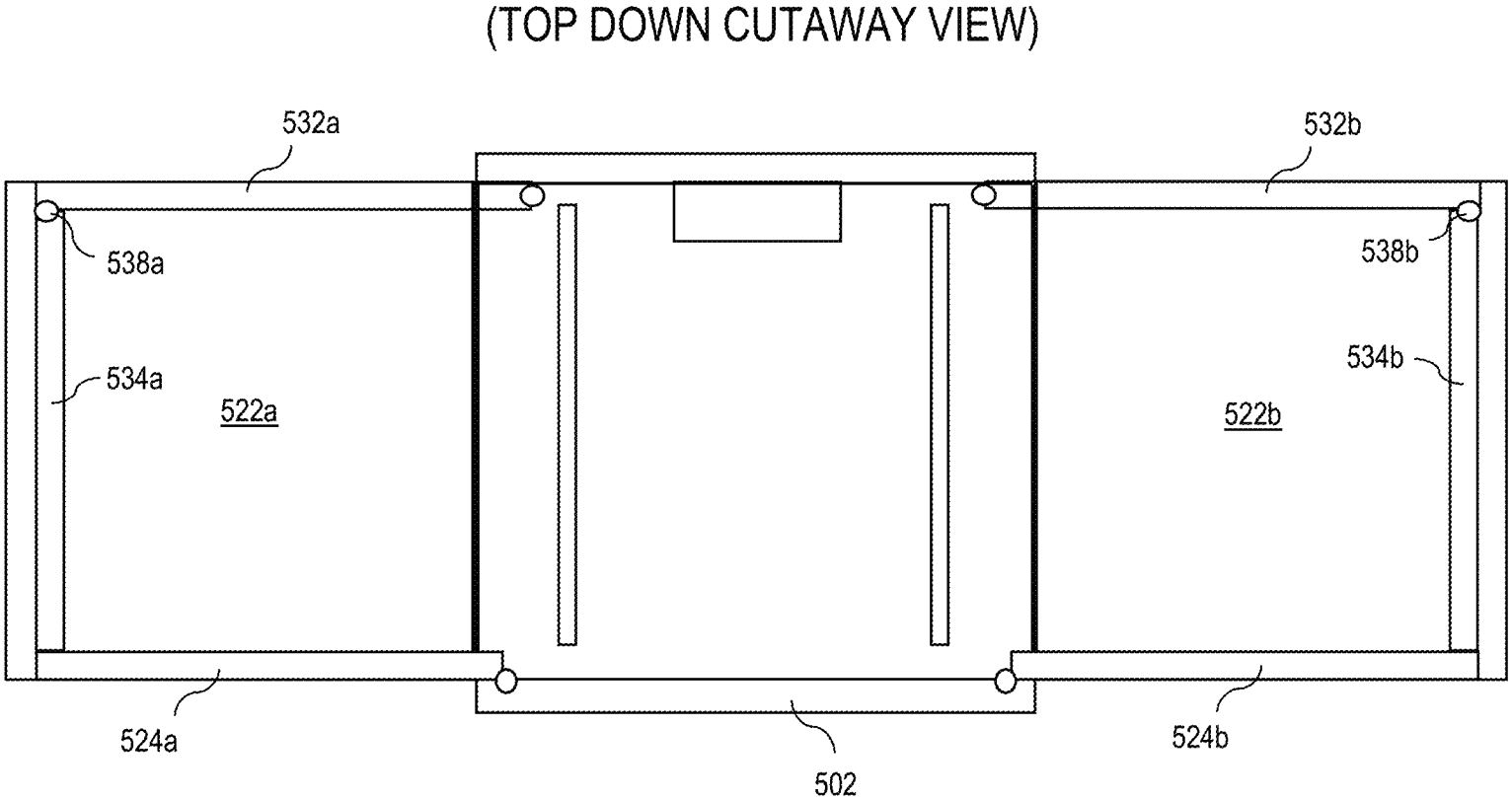
FIG. 12 is a top down cutaway view of the expandable container of FIG. 6, illustrating the deployment of swing panels forming the side expansion panels according to various aspects of the present disclosure.

FIG. 12 is a top down cutaway view of the expandable container 500, which illustrates the next step in deployment of the expandable sections of the container 500. As illustrated, the first side swing panel 534*a* is rotated, e.g., via the coupling hinge 538*a* away from the first rear swing panel 532*a* to form the left expansion side panel. In this example embodiment, the first side swing panel 534*a* locks to the first expansion roof panel 522*a* using locking mechanisms as described more fully herein. Analogously, the second side swing panel 534*b* is rotated, e.g., via the coupling hinge 538*b* away from the second rear swing panel 532*b* to form the right expansion side panel. In this example embodiment, the second side swing panel 534*b* locks to the second expansion roof panel 522*b* using locking mechanisms as described more fully herein.

Figure 13:
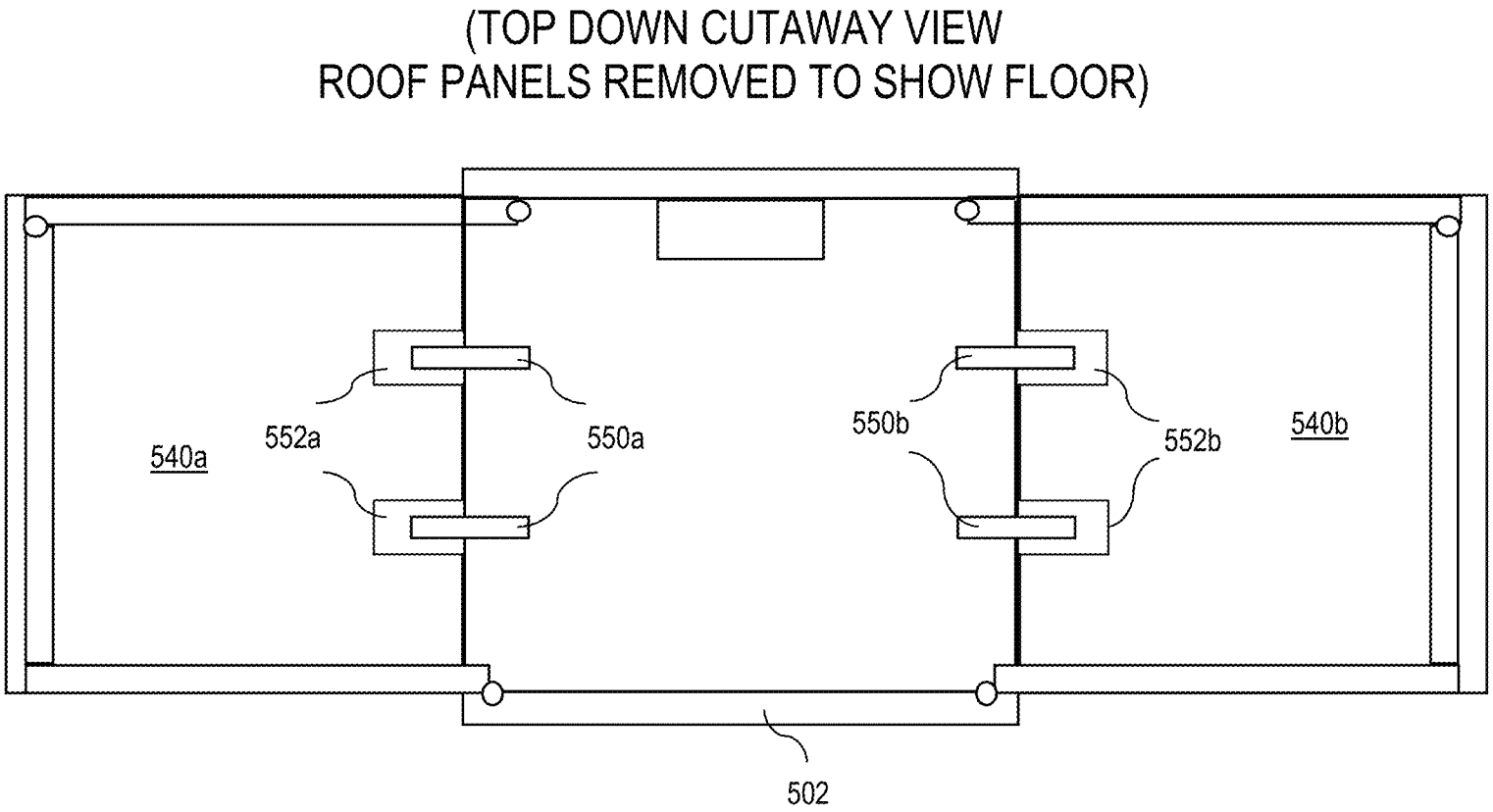
FIG. 13 is a top down cutaway view of the expandable container of FIG. 6, illustrating the deployment of the expansion floors according to various aspects of the present disclosure.

FIG. 13 is a top down cutaway view of the expandable container 500, which illustrates the next step in deployment of the expandable sections of the container 500. In this cutaway view, the roof panels are removed to demonstrate deployment of the expansion floors. As illustrated, the first expansion floor panel 540*a*, which was stowed vertically in the main container body, is rotated downward to provide the floor of the left-side expansion section. Analogously, the second expansion floor panel 540*b*, which was stowed vertically in the main container body, is rotated downward to provide the floor of the right-side expansion section.

In certain embodiments, the expansion floor panels 540*a* and 540*b* utilize hinges to achieve full articulation. In further embodiments, the expansion floor panels 540*a* and 540*b* comprise a sliding member 550*a*/550*b* and a slide channel 552*a*/552*b*, wherein the sliding member 550*a*/550*b* engages the slide channel 552*a*/552*b* as to allow the expansion floor panels 540*a* and 540*b* to extend laterally outward toward the other expansion panels. The expansion floor panels 540*a* and 540*b* can include locking members (e.g., analogous to the locking members 544*a*, 544*b*, to lock with the corresponding front, side, and rear expansion panels as described more fully herein).

In certain embodiments, a stand can be provided, e.g., which stows in the main container body. The stand can provide support of the roof when the container is stowed. Moreover, the stand can collapse, telescope, etc. The stand can also include an integrated tool for activating latches. Still further, the stand can deploy and retract various panels of the expandable container 500. The stand is described in greater detail herein in association with FIG. 16.

Figure 14:
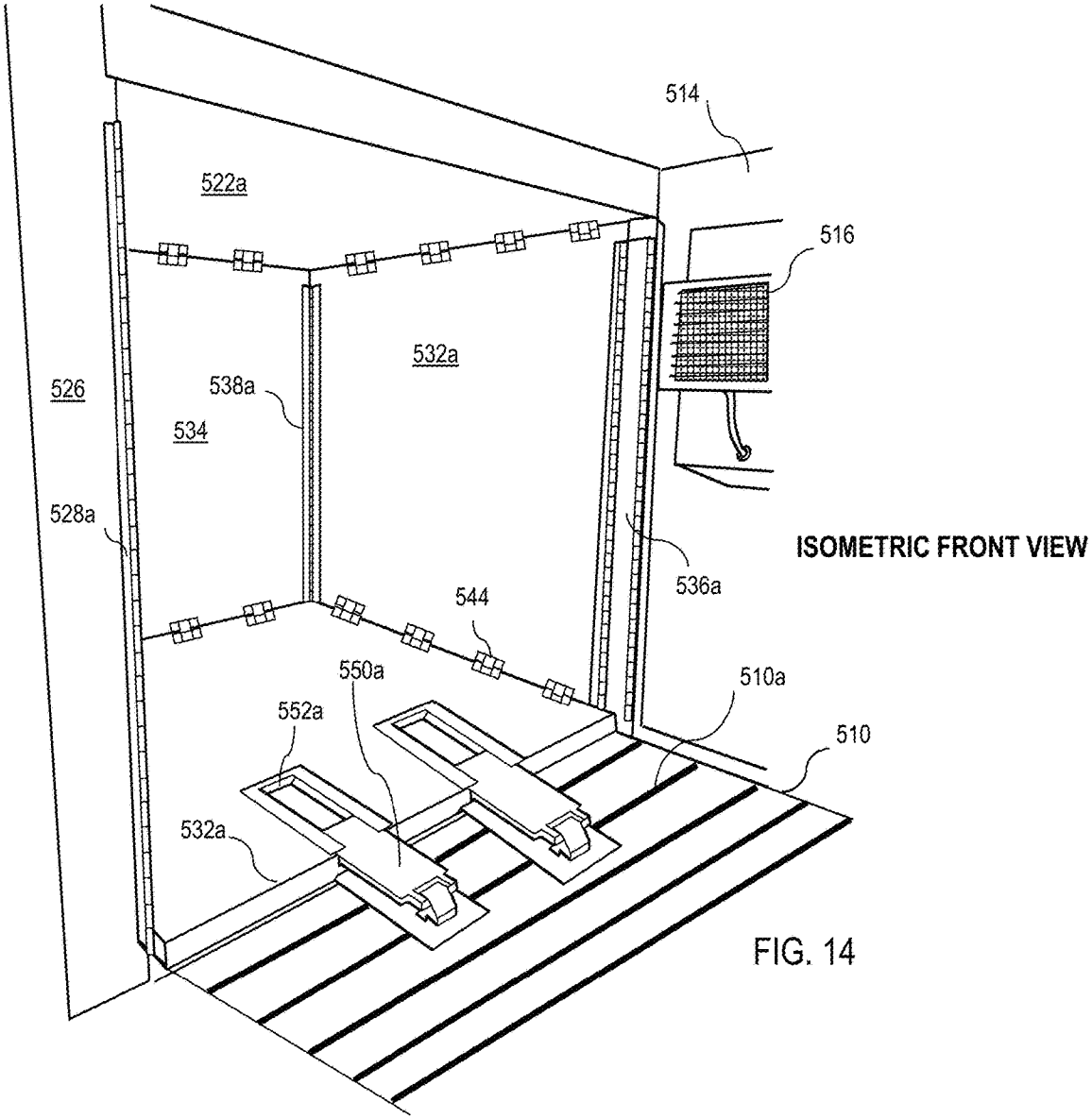
FIG. 14 is an isometric view of a section of the container of FIG. 6 according to aspects of the present disclosure.

Now referring to FIG. 14, which illustrates an isometric front view of the expandable container 500, the sliding members 550*a* (or 550*b* of FIG. 13) in the sliding channels 552*a* (or 552*b* of FIG. 13) may be attached to the floor panel 510 permanently (e.g., welded), or non-permanently using various fasteners such as screws, bolts, locks, etc. In further embodiments, the sliding members 550*a*/550*b* attach to the floor panel 510 via the floor panel extrusions 510*a*. The remaining reference numbers are shown for context.

Figure 15:
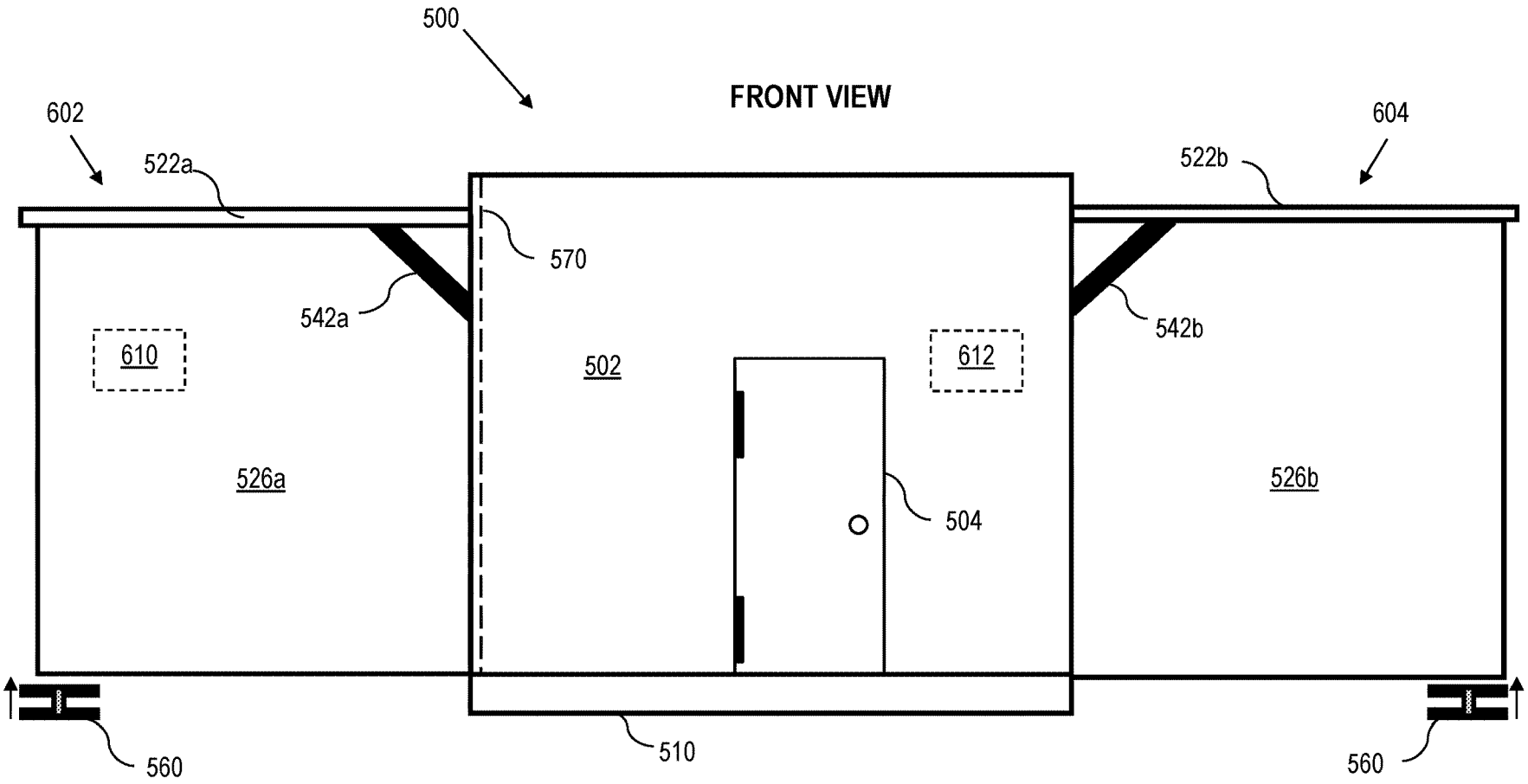
FIG. 15 is a front view of the expandable container in an expanded position according to aspects of the present disclosure.

FIG. 15 illustrates a front view of the expandable container 500, wherein both the first set and the second set of expansion panels are deployed. In multiple embodiments, the expandable container further comprises a vertically adjustable support jack 560, wherein the vertically adjustable support jacks 550 are configured to support the weight of at least one of the first set of expansion panels and the second set of expansion panels upon articulation of the expansion panels. Depending on the overall weight of each panel, the vertically adjustable support jacks 560 can help offset the stress load of the expandable container 500 panels.

Given the mobile nature of the expandable container 500, it is possible that the expandable container 500 may be placed in an area where the ground surface is not adequately level. The vertically adjustable support jacks 560 may be capable of offsetting the unlevel ground, thereby creating a level environment for the expandable container 500.

Still referring to FIG. 15, various embodiments of the expandable container 500 further comprise a spatial partition 570, e.g., disposed between the main container body and an expansion section, e.g., disposed between the expandable container 500 and the articulated expansion panels, thereby creating two distinct zones 602, 604, wherein each zone can be adjusted to different thermal temperatures. In an example embodiment, the expandable container 500 may be used as a refrigeration unit (e.g., food storage) where it may become desirable to have both a freezer environment and a refrigerated environment. FIG. 15 illustrates the plane of the spatial partition 570 via a dashed line.

The spatial partition 570 may be configured in a variety of ways such as a bulkhead, an insulated material (e.g., insulated wall), an articulating panel, combinations thereof, etc. In various embodiments, the spatial partition 570 enables an independent temperature modulation unit 610, 612 for each distinct zone 602, 604.

Further, the spatial partition 570 may comprise a seal that mitigates temperature transfers from one distinct zone 602 to another distinct zone 604. In practice, any number of zones can be created within the expanded container, thus allowing for the formation of a freezer and refrigerator, controlled room temperature (e.g., for pharmaceuticals), a mortuary, server room, plasma or other medical storage, sleeping quarters, or a host of other applications where environmental adjustability is desired.

Further, the spatial partition 570 comprises at least one surface configured to allow removal of food and drug residue. For example, if the expandable container 500 is utilized as a food storage container, there is a possibility that food or other contaminates may contact the spatial partition 570. Accordingly, a coating may be applied to the spatial partition 570 to aid clean up (e.g., a urethane composite coating).

In a scenario where the expandable container is being used as an insulated environment (hot/cold), insulation and R-value become important. In addition to utilizing the unitized panels as described herein, additional insulation materials may be placed between seams of the individual panels. One example of additional insulation is an ethylene propylene diene terpolymer (EPDM) or rubber gaskets. Moreover, adherence strips, insulating pillows, blankets, etc., may be placed along the seams of the various panels, whereby insulation materials may be attached (e.g., a hook and loop strip configured to accept foam insulation strips).

Figure 16:
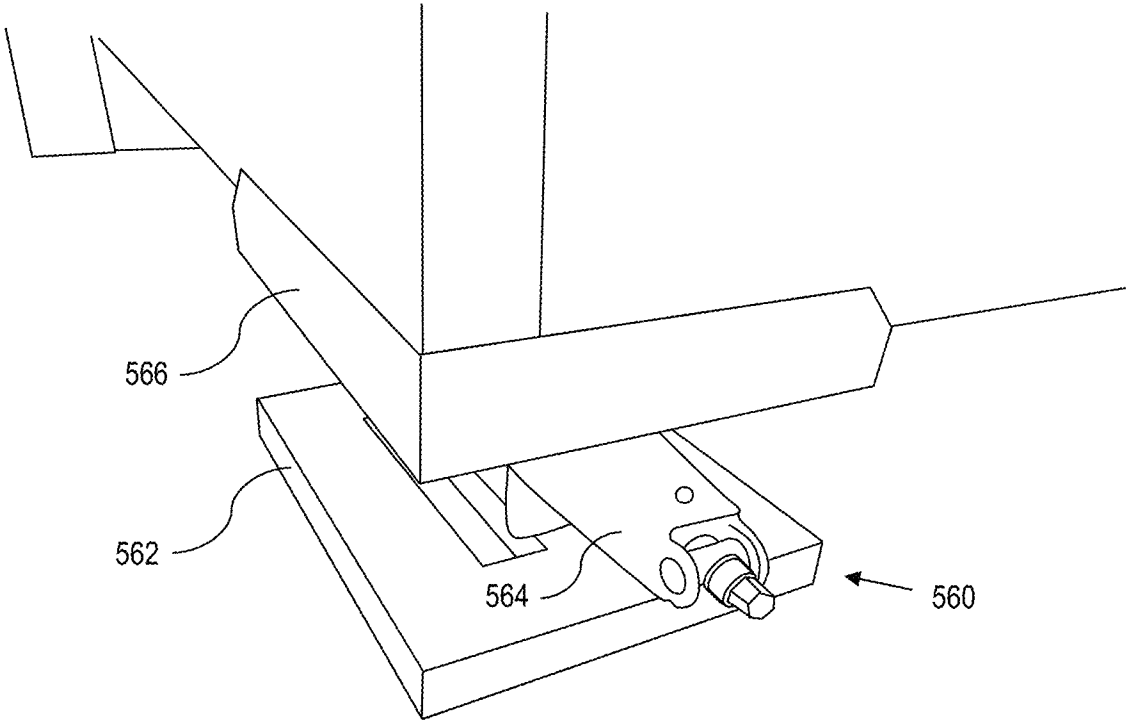
FIG. 16 is a view of an example leveling system for leveling an expanded container section according to aspects of the present disclosure.

FIG. 16 illustrates an embodiment of the vertically adjustable support jacks 560. Each vertically adjustable support jack 560 includes in general, a base 562, a vertically adjusting member 564 (e.g., a scissor member having a horizontal screw that raises or lowers a frame of hinged, rhombus-shaped linkages), and a guide plate 566. The guide plate 566 is configured to catch and align the various expansion panels once the expansion panels have been deployed. The raised recess wall of the guide plate 566 thus conveniently aligns the corresponding mating panels. In the example expandable container of FIGS. 6-16, there can be four adjustable support jacks, e.g., one for each expansion corner. In practice, additional jacks can also be used.

The figures associated with respect to the expandable container illustrate a sampling of the various possible embodiments. Different combinations of the present disclosure herein can yield alternate embodiments. For example, While the above implementation had two sets of expansion panels, even more expansion panels may be used.

For example, an expandable container similar to the above may further comprise a third set of expansion panels that correspond to a floor panel (e.g., floor panel 510 in FIG. 6). The third set of expansion panels is positioned on an alternate side of the first set of expansion panels and the second set of expansion panels. The third set of expansion panels comprise a third expansion roof panel that articulates as to correspond with the roof panel, a third expansion compound panel, the second compound panel comprising a third swing panel, and a fourth swing panel, a third expansion rear panel that articulates oppositely of the second compound panel, and a third expansion floor panel that articulates as to correspond with the floor panel. This embodiment further comprises a third plurality of locking members that facilitate fastening of the third set of expansion panels to one another, and a third plurality of hinges that facilitate articulation of the third set of expansion panels.

Continuing from above, in some embodiments, the expandable container comprises a fourth set of expansion panels that correspond to the floor panel, where the fourth set of expansion panels is positioned on an alternate side of the first set of expansion panels, the second set of expansion panels, and the third set of expansion panels. The fourth set of expansion panels comprise a fourth expansion roof panel that articulates as to correspond with the roof panel, a fourth expansion compound panel, the second compound panel comprising a third swing panel, and a fourth swing panel, a fourth expansion rear panel that articulates oppositely of the second compound panel, and a fourth expansion floor panel that articulates as to correspond with the floor panel. This embodiment also comprises a fourth plurality of locking members that facilitate fastening of the fourth set of expansion panels to one another, and a fourth plurality of hinges that facilitate articulation of the fourth set of expansion panels.

Miscellaneous

Based on the above, advantages with respect to containers and expandable containers become apparent. For instance, the containers ship and store in a relatively small footprint, thus saving transportation cost. The containers are rapidly deployable because there is no (or minimal) loose hardware, thus making the containers easy to unload and deploy, even in the field. The high thermal efficiency characteristics reduces energy consumption for operation and facilitates off-grid uses, e.g., solar, micro wind, etc.

Moreover, any of the embodiments herein can incorporate any combination of the following features: food-grade materials; wash-down materials; painted exteriors (which can include a solar reflective paint additive, insulating paint additive, combination thereof, etc.); panels can be gel coated; panels can be pigmented/painted differently (internally and externally); panels can include linings of metal or plastic; the container panels can be insulated (including any combination of VIP, aerogel, foam, etc.); the panels can include thermal breakers; insulation of the core (intermediate layer) can be protected (e.g., by a composite sheet, metal skin, plywood, plastic, combination thereof, etc.); integrated hardpoints for tiedown (e.g., logistics track/quick connect); one or more drains; an air transport pressure equalization hatch; wiper/weather stripping material (e.g., seals) to prevent water, sand, dust, and other intrusions; integral gaskets for environmental sealing and/or to form a thermal barrier when the container is closed/in a stowed position; the environmental unit (e.g., air conditioning, refrigeration unit, heating unit, etc.), can be wall mount including on an expandable wall, or roof mount, or repositionable; the roof can include lift-lock bars.

Moreover, in any of the illustrated embodiments, liners, e.g., pillows of insulating material, can be utilized (e.g., insulation, foam, aerogel, VIP, etc.) that cover exposed areas such as corners, hinges, seams, etc. These liners can attach using hook and loop fastener, snaps, etc.

Moreover, in any of the illustrated embodiments, catches/latches can be recessed, surface mount, over center, turn-to-lock (e.g., with camming action to draw a gasket tight), any combination thereof, etc.

Moreover, in any of the illustrated embodiments, gaskets can be provided at any joint, seam, edge, corner, etc. Here, gaskets can serve as thermal barriers, and can comprise two or more rows of gasket material with a still-air gap therebetween to minimize heat transfer.

Still further, in any of the illustrated embodiments, at least one panel can comprise a multilayer panel with high-value insulation and metallic skins (e.g., stainless steel, aluminum, etc.), fiber-reinforced plastic skins (e.g., fiberglass and resin, etc.); plastic skins (e.g., vinyl, polypropylene, etc.), combinations thereof, etc.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Aspects of the disclosure were chosen and described to best explain the principles of the disclosure and the practical application, and to enable others of ordinary skill in the art to understand the disclosure for various embodiments with various modifications as are suited to the particular use contemplated. Therefore, some aspects of the present disclosure can be executed in an order other than indicated herein.

What is claimed is:

1. An expandable container comprising:

a floor panel comprising extrusions;

a roof panel that corresponds to the floor panel;

a first set of expansion panels that correspond to the floor panel and the roof panel, the first set of expansion panels comprising:

a first expansion roof panel that articulates so as to correspond with the roof panel;

a first expansion front panel;

a first expansion compound panel, the compound panel comprising a first rear swing panel, and a first side swing panel;

a first expansion floor panel that articulates so as to correspond with the floor panel;

a plurality of locking members that facilitate fastening of the set of expansion panels to one another; and a plurality of hinges that facilitate articulation of the set of expansion panels;

wherein:

at least one panel of the set of expansion panels comprises a multilayer insulated panel comprising opposing external layers encasing an intermediate layer therebetween so as to form a unitized container panel, the intermediate layer comprising an insulation material and a buffer material encasing the insulation material; and the first expansion floor panel attaches to the extrusions of the floor panel by a sliding member and a corresponding slide channel.

2. The expandable container of claim 1, further comprising:

a second set of expansion panels that correspond to the floor panel, wherein the second set of expansion panels is positioned on an alternate side of the first set of expansion panels, the second set of expansion panels comprising;

a second expansion roof panel that articulates as to correspond with the roof panel;

a second expansion compound panel, the second compound panel comprising a second rear swing panel, and a second side swing panel;

a second expansion rear panel that articulates oppositely of the second compound panel; and a second expansion floor panel that articulates as to correspond with the floor panel;

a second plurality of locking members that facilitate fastening of the second set of expansion panels to one another; and a second plurality of hinges that facilitate articulation of the second set of expansion panels.

3. The expandable container of claim 1 further comprising:

a vertically adjustable support jack, wherein the vertically adjustable support jack is configured to support the weight of at least one of the first set of expansion panels upon articulation of the expansion panels; and a guide plate configured to align the various expansion panels once the expansion panels have been deployed, which are supported by the vertically adjustable support jack.

4. The expandable container of claim 1 further comprising:

at least one spatial partition within the expandable container, thereby creating at least two distinct zones, wherein each zone can be adjusted to different thermal temperatures.

5. The expandable container of claim 4 wherein the spatial partition further comprises:

an independent temperature modulation unit for each distinct zone.

6. The expandable container of claim 1, wherein:

the expandable container comprises a rigid steel frame and a set of stacking members disposed on each corner of the rigid steel frame, wherein the rigid steel frame is a rigid frame.

7. The expandable container of claim 6, wherein the rigid frame further comprises:

lifting rings on a top portion of the rigid frame; and tie downs on a bottom portion of the rigid frame.

8. The expandable container of claim 1, wherein the insulating material is a vacuum insulated panel.

9. The expandable container of claim 1, wherein the insulating material is an aerogel.

* * * * *